US006265814B1

(12) United States Patent
Yoshinaga et al.

(10) Patent No.: US 6,265,814 B1
(45) Date of Patent: Jul. 24, 2001

(54) SPARK PLUG HAVING A BYPASS ELECTRODE EXTENDING ALONG A BYPASS PATH BETWEEN CENTER AND GROUND ELECTRODE

(75) Inventors: Tohru Yoshinaga, Okazaki; Takehiko Kato, Gamagori; Tokio Kohama, Nishio; Hiroshi Yorita, Kariya; Masaki Takeyama, Okazaki; Masatoshi Ikeda, Hazu-gun, all of (JP)

(73) Assignee: Nippon Soken, Inc. (JP)

( * ) Notice: Subject to any disclaimer, the term of this patent is extended or adjusted under 35 U.S.C. 154(b) by 0 days.

(21) Appl. No.: 09/143,613

(22) Filed: Aug. 28, 1998

(30) Foreign Application Priority Data

Sep. 24, 1997 (JP) ..... 9-258805
Jan. 19, 1998 (JP) ..... 10-007877
Jun. 9, 1998 (JP) ..... 10-161022

(51) Int. Cl.[7] ..... H01T 13/20

(52) U.S. Cl. ..... 313/141; 313/142; 313/131 R; 313/140

(58) Field of Search ..... 313/141, 140, 313/131 A, 130, 123, 128, 142, 131 R

(56) References Cited

U.S. PATENT DOCUMENTS 3,883,762 * 5/1975 Harris et al. ..... 313/130
5,187,404 * 2/1993 Straub ..... 313/131 A
5,869,921 * 2/1999 Matsutani ..... 313/141
5,990,602 * 11/1999 Katoh et al. ..... 313/141

FOREIGN PATENT DOCUMENTS 57-40866 3/1982 (JP) .
57-65684 4/1982 (JP) .
57-151182 9/1982 (JP) .
4-349385 12/1992 (JP) .

OTHER PUBLICATIONS

Knowledge and Characteristic of Spark Plug, pp. 226–228, published by Sankaido with partial translation (1984).

* cited by examiner

*Primary Examiner*—Ashok Patel
*Assistant Examiner*—Karabi Guharay
(74) *Attorney, Agent, or Firm*—Nixon & Vanderhye PC

(57) ABSTRACT

To excellently grow flame kernel while lowering breakdown voltage, a bypass electrode comprising a semiconductor material is installed in a path bypassing an inductive spark gap between a center electrode and a ground electrode, and the center electrode and the ground electrode are electrically connected by the bypass electrode and capacitive discharge is carried out by applying breakdown voltage between the center electrode and the ground electrode via the bypass electrode, and thereafter, inductive discharge is carried out through the inductive spark gap.

44 Claims, 31 Drawing Sheets

SPARK PLUG HAVING A BYPASS ELECTRODE EXTENDING ALONG A BYPASS PATH BETWEEN CENTER AND GROUND ELECTRODE

CROSS REFERENCE TO RELATED APPLICATIONS

This application is based upon and claims priority from Japanese patent application Nos. Hei 9-258805, filed Sep. 24, 1997, and Hei 10-7877, filed Jan. 19, 1998, and Hei 10-161022, filed Jun. 9, 1998, the entire contents of which are incorporated herein by reference.

BACKGROUND OF THE INVENTION

1. Field of the Invention

The present invention relates to a spark plug for igniting fuel in an internal combustion engine, particularly to a spark plug which is preferably used in a direct injection engine.

2. Description of Related Art

Conventionally, according to a spark plug, a center electrode and a ground electrode are arranged to interpose a spark gap therebetween and discharge is carried out at the spark gap by applying high voltage (for example, 30 kV) between the center electrode and the ground electrode.

Further, according to Japanese Patent Application laid-open No. 57-40886, an intermediate electrode comprising a semiconductor is installed in a midway of a spark gap mentioned above and discharge is carried out via the intermediate electrode. According to the conventional technology, when high voltage is applied between the intermediate electrode and the ground electrode, firstly, discharge is carried out at a first spark gap between the center electrode and the intermediate electrode by which the potential of the intermediate electrode is increased and accordingly, discharge is carried out successively at a second spark gap between the intermediate electrode and the ground electrode. Therefore, breakdown voltage (required voltage) at the spark gap can be lowered.

Meanwhile, according to the above-described discharge, inductive discharge is carried out after capacitive discharge (breakdown), and air is subjected to insulation breakdown by the capacitive discharge, and heat is provided to surrounding fuel by the inductive discharge by which growth of flame kernel is expedited. Further, breakdown voltage in the capacitive discharge is much higher than breakdown voltage in the inductive discharge and the breakdown voltage in the capacitive discharge is referred to as breakdown voltage at the spark gap.

According to the above-described conventional spark plug, the capacitive discharge and the inductive discharge are carried out via the above-described intermediate electrode and accordingly, flame kernel formed in the inductive discharge is liable to be brought into contact with the intermediate electrode and energy of the flame kernel is liable to be absorbed by the intermediate electrode. Accordingly, the growth of the formed flame kernel is hindered and ignition performance is lessened.

According to another conventional spark plug, it is normally fastened to an engine block of an engine by screws installed in the lower portion of a main body metal piece. However, the male screw of the main body metal piece of the spark plug and the female screw of the engine block cannot specify as far as the position of the screw thread with regard to the respective base materials. Accordingly, in mounting the spark plug to an engine, the direction of the ground electrode cannot be specified in the cylinder of the engine.

In the case of an engine directly injecting fuel into a cylinder, or the like which has been rapidly developed in recent years, a spray of gasoline moves in the cylinder. When a projected object such as the ground electrode of the spark plug or the like is disposed upstream from the spark gap in respect of the spray flow, the spray flow which is supposed to reach the spark gap is hampered by the projected object.

Particularly, the breakdown voltage and the ignition performance are significantly influenced by a relationship between a plane where the spark is flown and a direction of the spray flow.

In order to overcome the foregoing problem, setting the direction of the ground electrode in a cylinder may be possible by installing a nut to determine a positional relationship between the female screw of the engine and the male screw of the plug. However, a deviation is caused in an amount of projecting the plug into the cylinder by an amount of a plate thickness of the plate member or the pitch (for example, 1.25 mm) of the fastening screw.

In the case of a direct injection engine, the concentration of spray passing through the spark gap portion differs by the projection amount of the plug, and accordingly, the ignition performance is significantly influenced thereby.

SUMMARY OF THE INVENTION

The present invention is made in light of the foregoing problems, and it is an object of the present invention to promote ignition performance while lowering breakdown voltage.

It is another object of the present invention to provide a spark plug whose direction of the ground electrode is adjustable after mounting the spark plug onto the engine, while maintaining the projection amount of the ground electrode.

According to a first aspect of the present invention, a bypass electrode is installed in a path bypassing a spark gap between a center electrode and a ground electrode. By applying breakdown voltage between the center electrode and the ground electrode, capacitive discharge is carried out via the bypass electrode first, and thereafter, inductive discharge is carried out via the spark gap.

Accordingly, the capacitive discharge is carried out via the bypass electrode, and breakdown voltage can be lowered. Furthermore, since the inductive discharge is carried out via the spark gap, a flame kernel formed during the inductive discharge is prevented from contacting the bypass electrode, and the energy of the flame kernel is prevented from being absorbed by the bypass electrode. Therefore, the formed flame kernel can be grown excellently, and the ignition performance is improved.

According to another aspect of the present invention, the spark plug has an engaging mechanism which makes first main body and second main body movable in a direction of the central axis of the two main bodies. The engaging mechanism engages the two main bodies when the first main body is disposed at a first predetermined position in the central axis direction in a state where the second main body is attached to the engine. When the first main body is disposed at a second predetermined position in the central axis direction, the engagement is released and the first main body and an insulator are rotatable in the circumferential direction.

According to the second aspect of the present invention, in the state where the second main body is attached to the engine, that is, in a state where the spark plug is fixed to the engine, the two main bodies can be fixed by setting the position of the first main body at the first predetermined position after the two main bodies are brought into a desired positional relationship at the second predetermined position by rotating the first main body and the insulator in the circumferential direction.

Therefore, after fastening the plug to the engine, not only the directions of the ground electrode fixed to the first main body and the bypass electrode fixed to the insulator can be adjusted but also the directions can be adjusted without changing a positional relationship between the second main body and the engine, and accordingly, the adjustment can be carried out while maintaining the projection amount of the plug in the cylinder.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

An explanation will be given of embodiments of the present invention in reference to the drawings as follows.

(First Embodiment)

Figure 1:
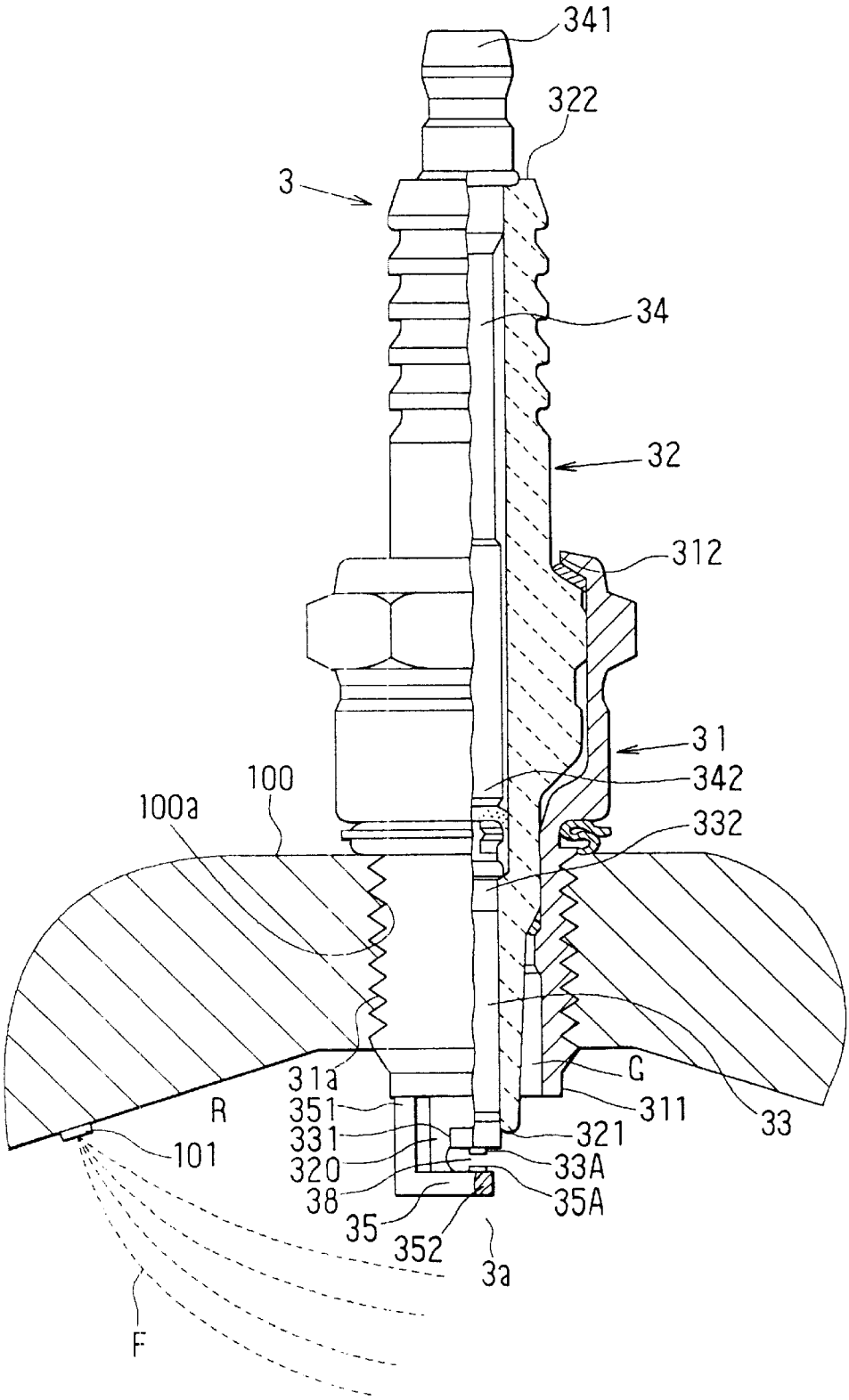
FIG. 1 is a partially sectional view of a spark plug according to a first embodiment of the present invention.

According to the embodiment, as shown by FIG. 1, a spark plug of the present invention is applied to a so-called direct injection engine in which liquid fuel F is sprayed from a spray nozzle 101 installed in an engine block 100 of an engine toward a combustion chamber R in the engine block 100. As shown by FIG. 1, the spark plug 3 is mounted to the engine block 100 constituting the combustion chamber R such that a side of one end portion 3*a* of the spark plug 3 (ignition unit) is inserted into the combustion chamber R.

The spark plug 3 is installed with an attachment metal piece (main body metal piece) 31 in a cylindrical shape and a screw thread 31*a* is formed on the outer peripheral portion of the attachment metal piece 31. The spark plug 3 is mounted to the engine block 100 attachably and detachably by screw-coupling the screw thread 31*a* with a tapped hole 100*a* formed in the engine block 100.

A cylindrical insulator 32 (for example, porcelain insulator or the like) is incorporated in and held by the attachment metal piece 31. A center electrode 33 and a stem portion (shaft portion) 34 is incorporated in and held by the insulator 32. One end portion 351 of a ground electrode 35 substantially in an L-like shape is fixed to one end portion 311 of the attachment metal piece 31. Further, one end portion 321 and other end portion 322 of the insulator 32 are exposed from the one end portion 311 and other end portion 312 of the attachment metal piece 31.

Further, one end portion 331 of the center electrode 33 is exposed from the one end portion 321 of the insulator 32 and other end portion 341 of the stem portion 34 is exposed from the other end portion 322 of the insulator 32. Further, other end portion 332 of the center electrode 33 is electrically connected to other end portion 342 of the stem portion 34.

Further, the side of the one end portion 321 of the insulator 32 and the side of the one end portion 311 of the attachment metal piece 31 are arranged by interposing gas volume G in the diameter direction. Further, the inner peripheral portion of the one end portion 321 of the insulator 32 is brought into contact with the outer peripheral portion of the one end portion 331 of the center electrode 33.

Figure 2A:
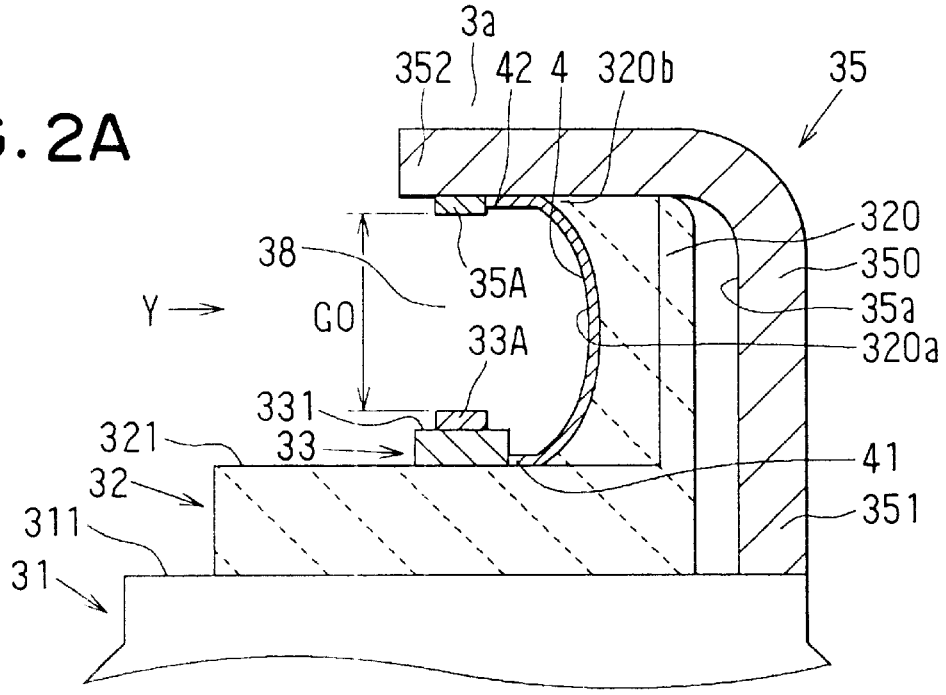
FIG. 2A is a sectional view of an ignition portion of the spark plug according to the first embodiment of the present invention.

Further, as shown by FIG. 2A, the ground electrode 35 is extended from the one end portion 351 in the axial direction of the attachment metal piece 31 (upper side of FIG. 2), bent at a midway, extended to the side of the central portion of the attachment metal piece 31 (in other words, side of center electrode 33) and the other end portion 352 are arranged at a position which is opposed to the one end portion 331 of the center electrode 33. Thereby, a spark gap 38 is formed between the other end portion 352 of the ground electrode 35 and the one end portion 331 of the center electrode 33 and a portion of the ground electrode 35 other than the other end portion 352 (hereinafter, referred to as an extended portion 350) is arranged to bypass the spark gap 38. Incidentally, the spark gap 38 is a shortest path between the other end portion 352 of the ground electrode 35 and the one end portion 331 of the center electrode 33.

Further, a noble metal chip 33A is integrally mounted on a portion of the one end portion 331 of the center electrode 33 which is opposed to the spark gap 38 and a noble metal chip 35A is integrally mounted on a portion of the other end portion 352 of the ground electrode 35 which is opposed to the spark gap 38. The noble metal chips 33A and 35A comprise a noble metal material of, for example, Pt (Platinum) alloy material or Ir (Iridium) alloy material or the like. Further, a gap distance G0 of the spark gap 38 is set to, for example, 3 mm. When the gap distance G0 of the spark gap 38 is excessively short, the ignition performance of lean fuel or fuel in a droplet shape may not be provided excellently and accordingly, the gap distance G0 is preferably 0.75 mm or more. Further, when the gap distance G0 of the spark gap 38 is excessively long, a total of the spark plug 3 is magnified and accordingly, the gap distance G0 is preferably 10.0 mm or less.

A projected portion 320 projecting in the axial direction is integrally mounted on the one end portion 321 of the insulator 32 and the projected portion 320 is extended along a path bypassing the spark gap 38 on the side of the spark gap 38 of the extended portion 350 of the ground electrode 35 (left side of FIG. 2A). A front end portion 320*b* of the projected portion 320 is brought into contact with a face 35*a* of the ground electrode 35 on the side of the spark gap 38 and a face 320*a* of the projected portion 320 on the side of the spark gap 38 is formed in substantially a circular arc shape.

Further, a bypass electrode 4 comprising a semiconductor material having the electric resistance of semiconductor (for example, 1 through $10^4$ Ωcm) is formed on the face 320*a* of the projected portion 320. The bypass electrode 4 is continuously extended from one end portion 41 to other end portion 42, the one end portion 41 is electrically connected to the one end portion 331 of the center electrode 33 and the other end portion 42 is electrically connected to the other end portion 352 of the ground electrode 35. Accordingly, the one end portion 331 of the center electrode 33 is electrically connected to the other end portion 352 of the ground electrode 35 by the bypass electrode 4.

Figure 2B:
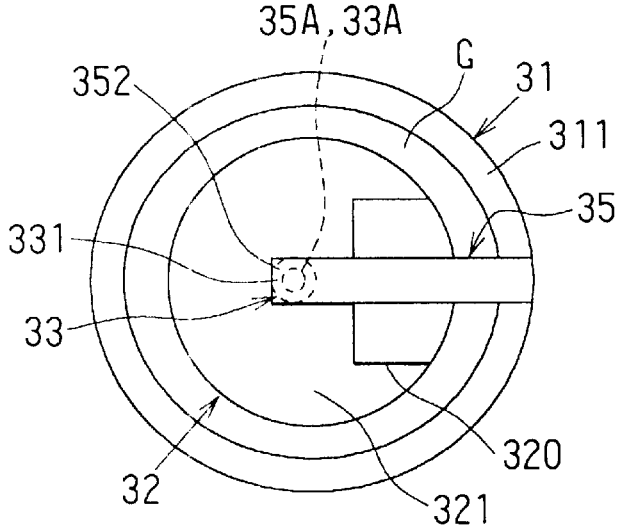
FIG. 2B is a plan view of the ignition portion of the spark plug according to the first embodiment of the present invention.
Figure 2C:
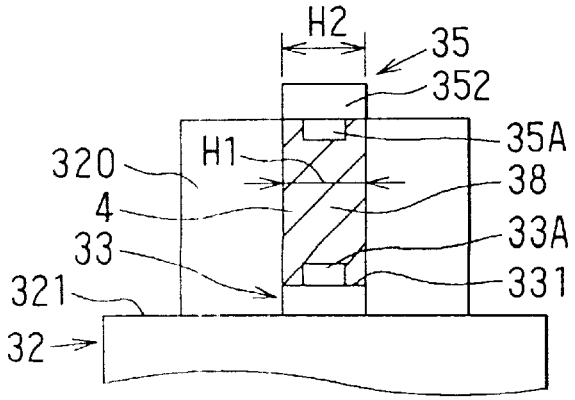
FIG. 2C is a front view of the ignition portion of the spark plug according to the first embodiment, viewed from an arrow Y.

Further, as shown by FIG. 2C, a width H1 of the bypass electrode 4 is substantially equal to or less than a width H2 of the ground electrode 35 and is, for example, about 2.5 mm. This is because when the width H1 of the bypass electrode 4 is excessively large, capacitive discharge (breakdown) may be caused from the ground electrode 35 to the attachment metal piece 31. Here, although hatching is given to the bypass electrode 4 in FIG. 2C for convenience of explanation, the hatching indicates the outlook and not a section thereof.

The semiconductor is made by baking, for example, CuO, $Cr_2O_3$, CoO and $Fe_3O_4$ on an insulator ($Al_2O_3$) and is adjusted by controlling a particle size distribution and a thickness such that the resistivity becomes 1 through 30 Ωcm. Further, the semiconductor material may be made by fitting a ceramics member of SiC or TiC.

After spraying the semiconductor material on the face 320*a* of the projected portion 320, the bypass electrode 4 is formed by sintering the semiconductor material. Further, when the film thickness of the bypass electrode 4 is excessively thin an effect, mentioned later, may not be obtained excellently and when the film thickness of the bypass electrode 4 is excessively thick, a disadvantage in forming the electrode such that the spraying operation takes much time or the like is caused and accordingly, the film thickness of the bypass electrode 4 is preferably in a range of 0.03 mm through 2 mm. According to the embodiment, the film thickness is set to, for example, 0.5 mm.

Further, the ground electrode 35 is grounded via the attachment metal piece 31 and the engine block 100 and the center electrode 33 is applied with negative high voltage (about −10 kV through −35 kV) by voltage supplying means such as an ignition coil or the like, not illustrated.

Next, an explanation will be given of the operation by the above-described constitution in reference to FIGS. 3A and 3B.

Figure 3A:
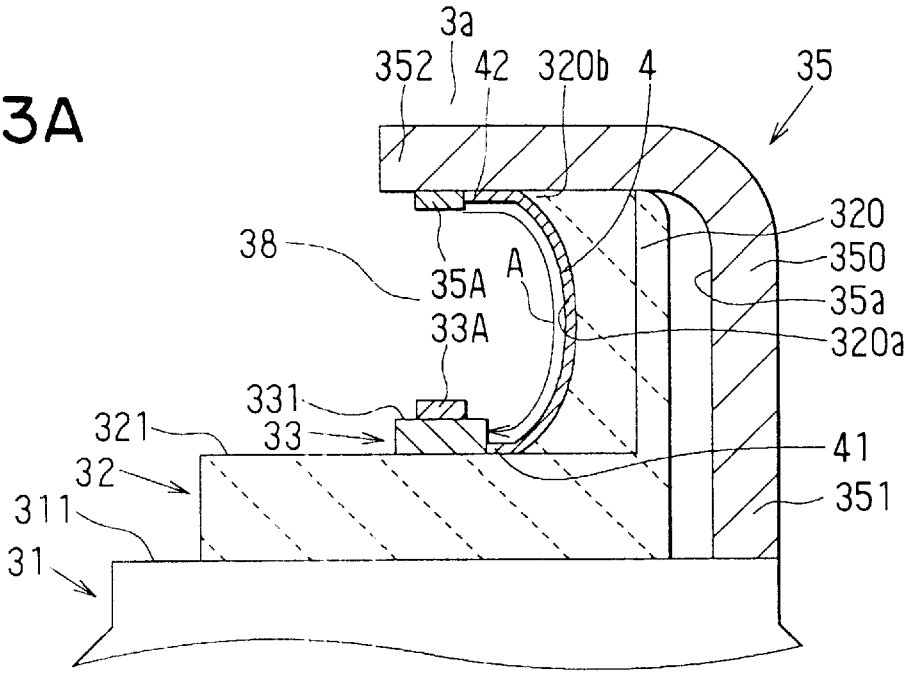
FIG. 3A is a sectional view of the ignition portion of the spark plug when a capacitive discharge occurs according to the first embodiment of the present invention.
Figure 3B:
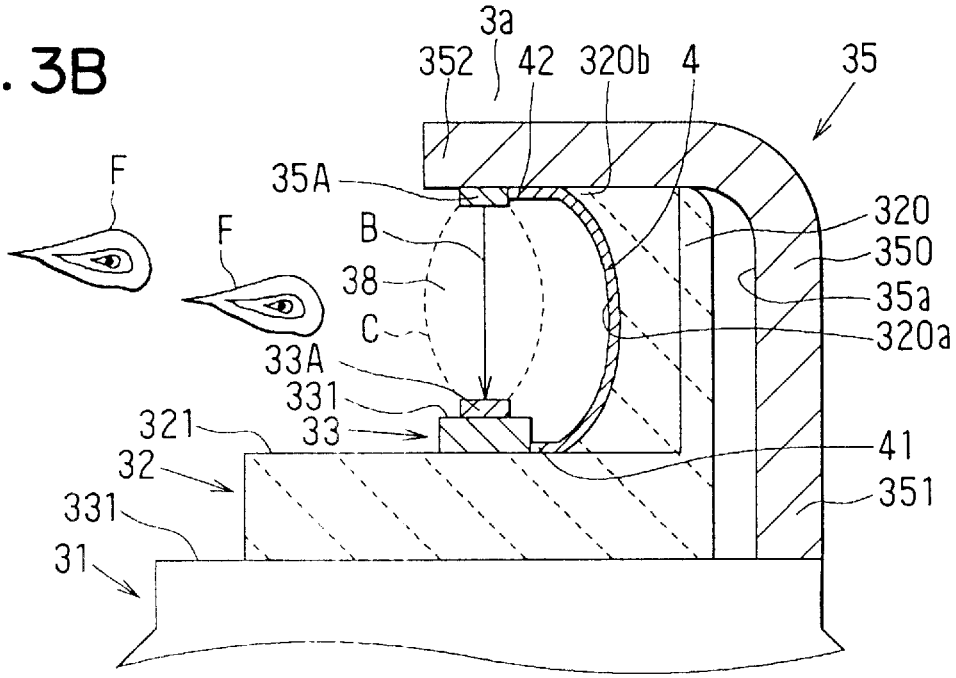
FIG. 3B is a sectional view of the ignition portion of the spark plug when a inductive discharge occurs according to the first embodiment of the present invention.

First, when the above-described high voltage is applied on the center electrode 33, as shown by an arrow mark A in FIG. 3A, capacitive discharge (creeping discharge) is carried out from the noble metal chip 35A of the ground electrode 35 to the noble metal chip 33A of the center electrode 33 via a surface (creeping face) of the bypass electrode 4. The bypass electrode is made by a semiconductor and accordingly, free electrons are discharged from the surface of the semiconductor by applying the voltage and the creeping discharge is caused at lower breakdown voltage.

In this embodiment, before the discharge, the electric resistance of the path via the bypass electrode is set to be smaller than that of the spark gap. After capacitive discharge, the electric resistance of the path via the bypass electrode is set to be larger than that of the spark gap.

Accordingly, immediately after discharge, capacitive discharge (creeping discharge) is carried out from the ground electrode to the center electrode via the surface (creeping face) of the bypass electrode. In the capacitive discharge, free electrons are likely to be emitted from the semiconductor material of the bypass electrode and the capacitive discharge is carried out at a lower breakdown voltage. When the capacitive discharge is caused, mixture (air) at a vicinity of the discharge path is ionized. When the mixture is ionized, the electric resistance value at the ionized portion becomes small and accordingly, the inductive discharge thereafter flows at a portion having smaller electric resistance value and therefore, the discharge path is gradually shifted and finally the discharge is carried out via the spark gap.

By the capacitive discharge, mixture (air) at a vicinity of the bypass electrode 4 is ionized. Thereby, the electric resistance of the mixture (air) at a vicinity of the bypass electrode 4 becomes smaller than that of the bypass electrode 4. Therefore, as shown by an arrow mark B in FIG. 3B, inductive discharge is shifted toward the spark gap 38 constituting the shortest path at a vicinity of the bypass electrode 4 and is finally carried out via the spark gap 38.

By the inductive discharge, temperature of the spark gap 38 and its neighboring portion is elevated and an ignition source C is formed. Further, when the sprayed fuel F in a droplet shape passes through the ignition source C, the fuel F is heated and flame kernel is formed. Further, the flame kernel is grown and its flame face forms a new ignition source and the contiguous fuel F is ignited successively.

Next, an explanation will be given of an effect achieved by the embodiment.

First, the capacitive discharge is carried out via the bypass electrode 4 and accordingly, the voltage of the capacitive discharge can be made lower than that in the case where the capacitive discharge is carried out through the spark gap 38. In other words, the path of the capacitive discharge can be enlarged compared with the case where the capacitive discharge is carried out through the spark gap 38.

Further, although the voltage of the inductive discharge necessary for the inductive discharge (for example, 500 V) is smaller than the voltage of the capacitive discharge (for example, 10 kV), only the inductive discharge is carried out at the spark gap 38 and accordingly, the gap distance G0 of the spark gap 38 (that is, path of inductive discharge) can be enlarged in comparison with the case where the capacitive discharge and the inductive discharge are carried out at the spark gap 38.

In this way, by enlarging the path of the capacitive discharge and the path of the inductive discharge, the above-described ignition source C can be enlarged and therefore, a probability of passing the fuel F through the ignition source C can be made high. Accordingly, the ignition performance of the fuel F can be promoted.

Particularly, when fuel is sprayed in droplets as in a direct injection engine or when a fuel injection amount is small as in idling or the like, or when injection mode is changed by air flow in a combustion chamber-and the like, the ignition performance is improved.

(Second Embodiment)

Figure 4:
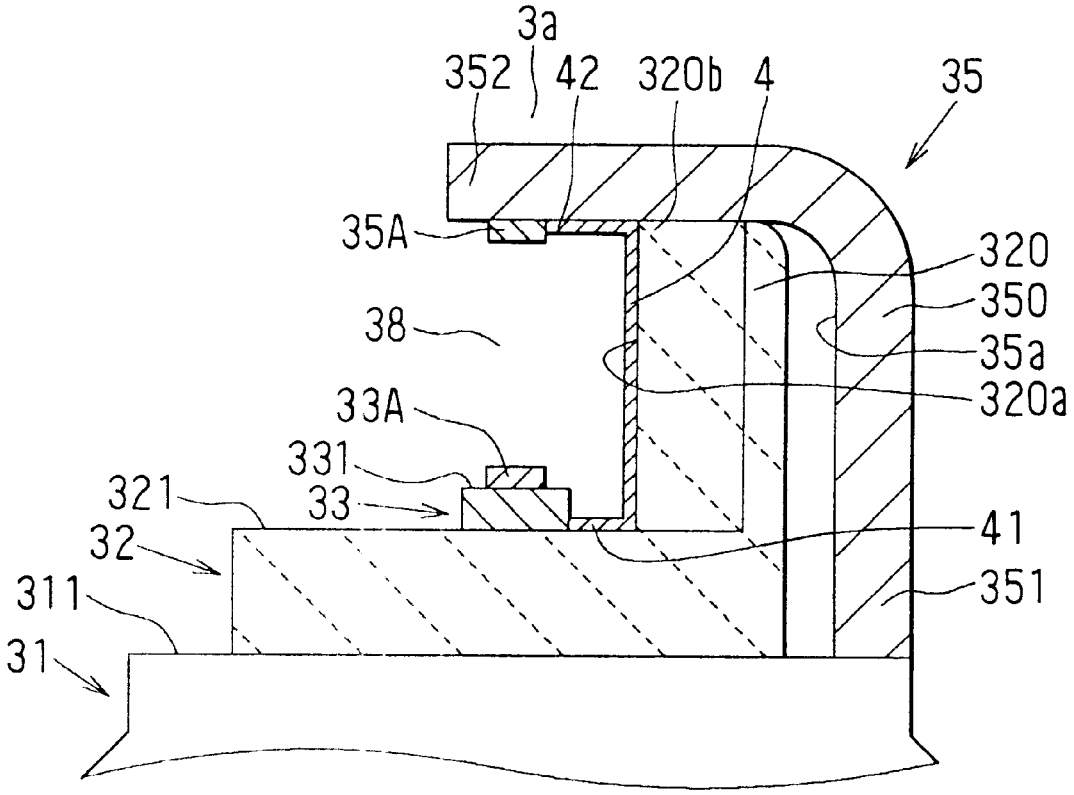
FIG. 4 is a sectional view of an ignition portion of a spark plug according to a second embodiment of the present invention.

According to this embodiment, the first embodiment is modified and as shown by FIG. 4, the face 320*a* of the projected portion 320 on the side of the spark gap 38 is formed in a flat shape extending in parallel with the axial direction. Thereby, the fabrication performance of the insulator 32 is promoted compared with the case where the face 320*a* is formed in a circular arc shape.

(Third Embodiment)

Figure 5A:
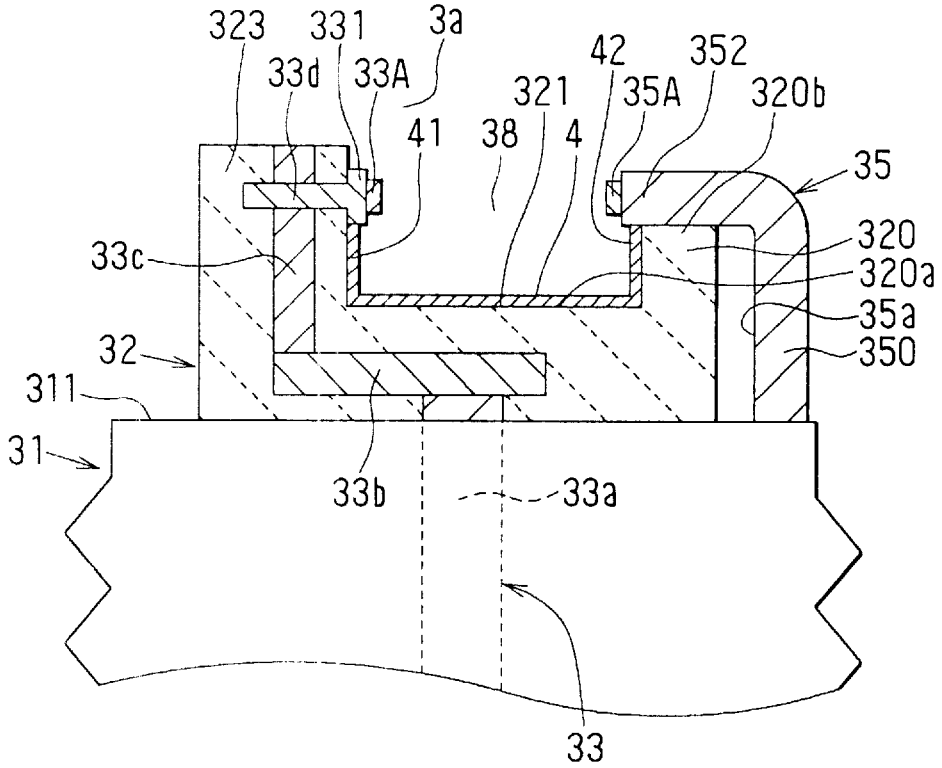
FIG. 5A is a sectional view of an ignition portion of a spark plug according to a third embodiment of the present invention.
Figure 5B:
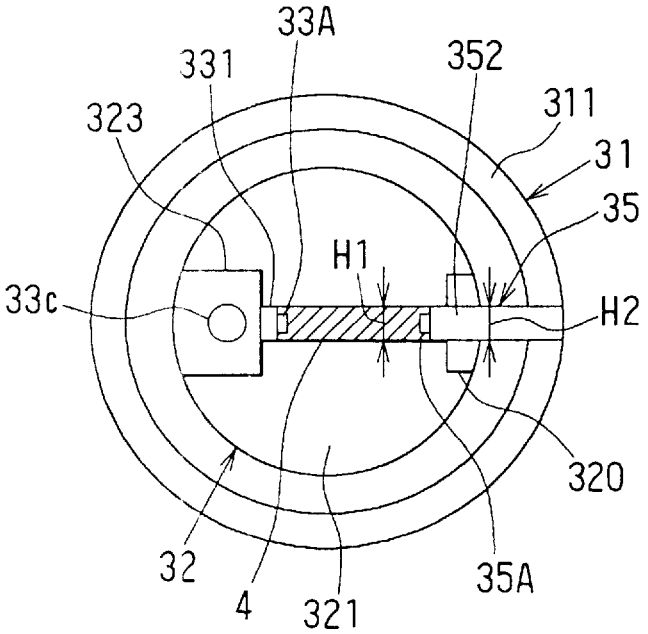
FIG. 5B is a plan view of the ignition portion of the spark plug according to the third embodiment of the present invention.

According to this embodiment, the first embodiment is modified and as shown by FIGS. 5A and 5B, a projected portion 323 projecting in the axial direction is integrally mounted on the one end portion 321 of the insulator 32 to be opposed to the projected portion 320 via a distance and the one end portion 331 of the center electrode 33 is arranged at a portion of the projected portion 323 which is opposed to the ground electrode 35.

Further, the center electrode 33 comprises a first electrode portion 33*a*, a second electrode portion 33*b*, a third electrode portion 33*c* and a fourth electrode portion 33*d*. Further, the first electrode portion 33*a* is arranged to extend in the axial direction at the central portion of the insulator 32 and the fourth electrode portion 33*d* is arranged to extend in the diameter direction at the projected portion 323. The one end portion 331 of the center electrode 33 is formed by one end portion of the fourth electrode portion 33*d*. Further, the first electrode portion 33*a* is electrically connected to the fourth electrode portion 33*d* via the second and the third electrode portions 33*b* and 33*c*.

Thereby, the one end portion 321 of the insulator 32 as well as the projected portions 320 and 323 are arranged to bypass the spark gap 38. Further, the bypass electrode 4 is mounted on faces of the one end portion 321 and the projected portions 320 and 323 of the insulator 32 which are opposed to the spark gap 38. Thereby, the bypass electrode 4 is arranged along a path bypassing the spark gap 38. The width H1 of the bypass electrode 4 is substantially the same as the width H2 of the ground electrode 35.

At this point, explaining simply a method of integrating the insulator 32 and the center electrode 33, firstly, an insulator having holes into which the first through the fourth electrode portions 33*a*, 33*b*, 33*c* and 33*d* of the center electrode 33 can be inserted is prepared, the first through the fourth electrode portions 33*a*, 33*b*, 33*c* and 33*d* are inserted into the insulator and thereafter, they are welded by copper glass.

Also in this way, an effect similar to that of the first embodiment can be achieved.

(Fourth Embodiment)

Figure 6A:
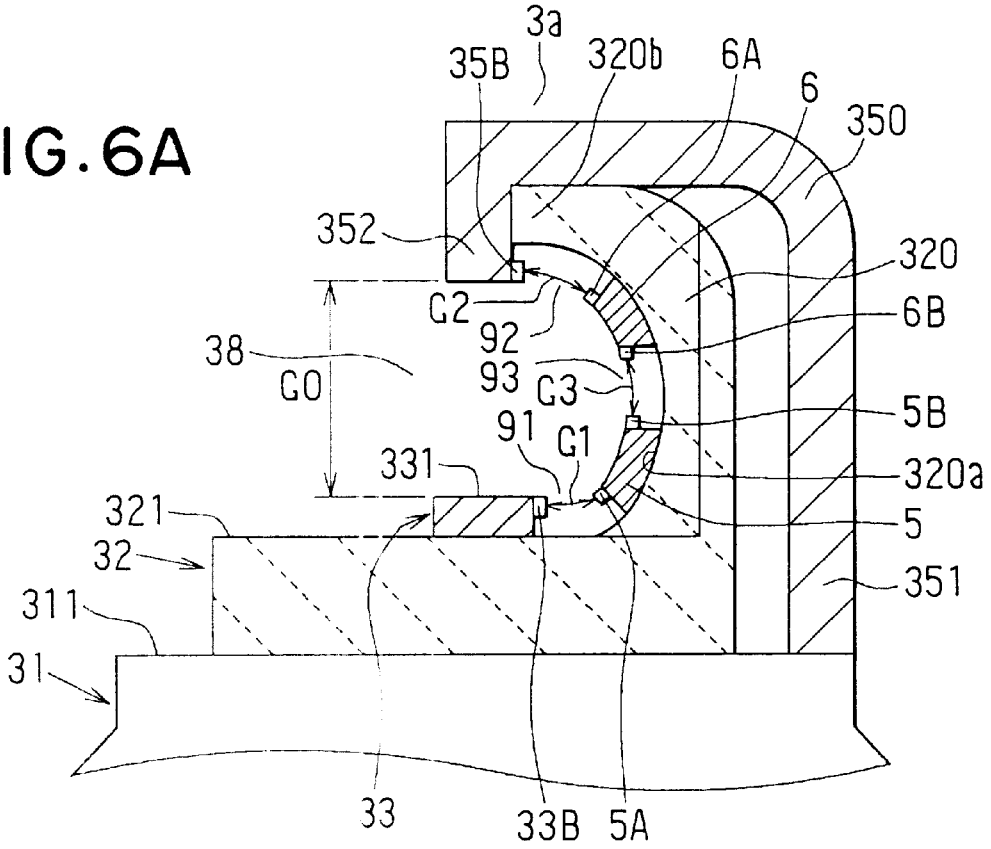
FIG. 6A is a sectional view of an ignition portion of a spark plug according to a fourth embodiment of the present invention.

According to this embodiment, the first embodiment is modified and as shown by FIG. 6A, a first and a second bypass electrode 5 and 6 comprising conductive material are installed in the face 320*a* of the projected portion 320 of the insulator 32 on the side of the spark gap 38. Further, a front end portion 320*b* of the projected portion 32 is extended to a portion which is opposed to the center electrode 33 and the front end portion 320*b* is covered with the other end portion 352 of the ground electrode 35.

The first bypass electrode 5 is arranged such that a first bypass gap 91 is formed between the first bypass electrode 5 and the one end portion 331 of the center electrode 33. The second bypass electrode 6 is arranged such that a second bypass gap 92 is formed between the second bypass electrode 6 and the other end portion 352 of the ground electrode 35 and a third bypass gap 93 is formed between the second bypass electrode 6 and the first bypass electrode 5.

Further, the noble metal chip 33B is integrally mounted on a portion of the one end portion 331 of the center electrode 33 which is opposed to the first bypass gap 91, and a noble metal chip 5A is integrally mounted on a portion of the first bypass electrode 5 which is opposed to the first bypass gap 91. Further, a noble metal chip 35B is integrally mounted on a portion of the other end portion 352 of the ground electrode 35 which is opposed to the second bypass gap 92 and a noble metal chip 6A is integrally mounted on the second bypass electrode 6 which is opposed to the second bypass gap 92. Further, a noble metal chip 5B is integrally mounted on a portion of the first bypass electrode 5 which is opposed to the third bypass gap 93 and a noble metal chip 6B is integrally mounted on the second bypass electrode 6 which is opposed to the third bypass gap 93.

Further, each of gap distances G1, G2 and G3 of the respective bypass gaps 91, 92 and 93 is set to be shorter than the gap distance G0 of the spark gap 38 and further, a total gap distance GA (G1+G2+G3) of the respective bypass gaps 91, 92 and 93 is set to be longer than the gap distance G0 of the spark gap 38. According to the embodiment, the gap distance G0 is set to, for example, 3 mm, the gap distance G1 is set to, for example, 1.1 mm, the gap distance G2 is set to, for example, 1.1 mm, the gap distance G3 is set to, for example, 1.1 mm and the total gap distance GA is set to, for example, 3.3 mm.

Figure 6B:
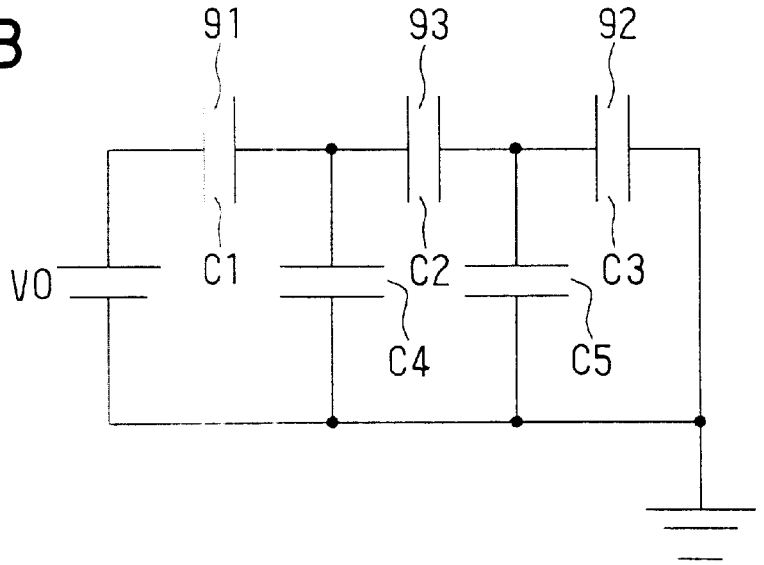
FIG. 6B is a schematic circuit diagram of the spark plug according to a fourth embodiment of the present invention.

Further, the above-described respective electrodes constituting the respective bypass gaps 91, 92 and 93 form condensers C1, C2 and C3 as shown by FIG. 6B. Further, in the above-described respective bypass electrodes 5 and 6 and the ground electrode 35 (extended portion 350) are oppositely arranged via distances (gaps) and accordingly, condensers C4 and C5 are formed by the first and the second bypass electrodes 5 and 6 and the ground electrode 35. Further, notation V0 in FIG. 6B designates high voltage applied between the ground electrode 35 and the center electrode 33.

The condensers C4, C5 are arranged in series with one gap (for example, 91) (that is, condenser C1) in the bypass gaps (91 through 93) and in parallel with a gap (for example, 92) (that is, condenser C2) on the side of the ground electrode 35 contiguous to the gap 91. Therefore, the voltage applied to the gap 91 can be elevated. Therefore, the capacitive discharge is facilitated at the gap 91.

Further, each capacitance of the respective condensers C4 and C5 is set to be 5 times as large as or higher than (for example, 9 times) each capacitance of the respective condensers C1, C2 and C3. Therefore, the capacitive discharge is carried out at the bypass gaps (91 through 93) by only applying voltage 1.1 through 1.2 times as large as the breakdown voltage at one spark gap (91 through 93) between the center electrode 33 and the ground electrode 35. Normally, the capacitance of a condenser is inversely proportional to a distance "d" between opposed electrodes and in proportion to an area S of the opposed electrodes as well as the dielectric constant e of an environment between the electrodes and accordingly, the capacitance of the condenser is set in a relationship among the distance "d", the area S and the dielectric constant e. Further, by interposing the insulator 32 (projected portion 320) having the dielectric constant higher than that of air between electrodes of the respective condensers C4 and C5, the capacitance of the condensers C4 and C5 can effectively be enlarged.

Next, an explanation will be given of the operation by the above-described constitution in reference to FIGS. 7A and 7B.

First, when the capacitance of the condensers C1 through C3 is set to C and the capacitance of the condensers C4 and C5 are set to, for example, 9C, immediately after applying high voltage mentioned above, voltage applied on the first bypass gap 91 becomes 0.9V0 and the voltage applied on the third bypass gap 93 becomes 0.1V0. In this way, the voltage applied on the first bypass gap 91 becomes higher and therefore, capacitive discharge is carried out at the first bypass gap 91 as shown by an arrow mark A1 in FIG. 7A.

Figure 7A:
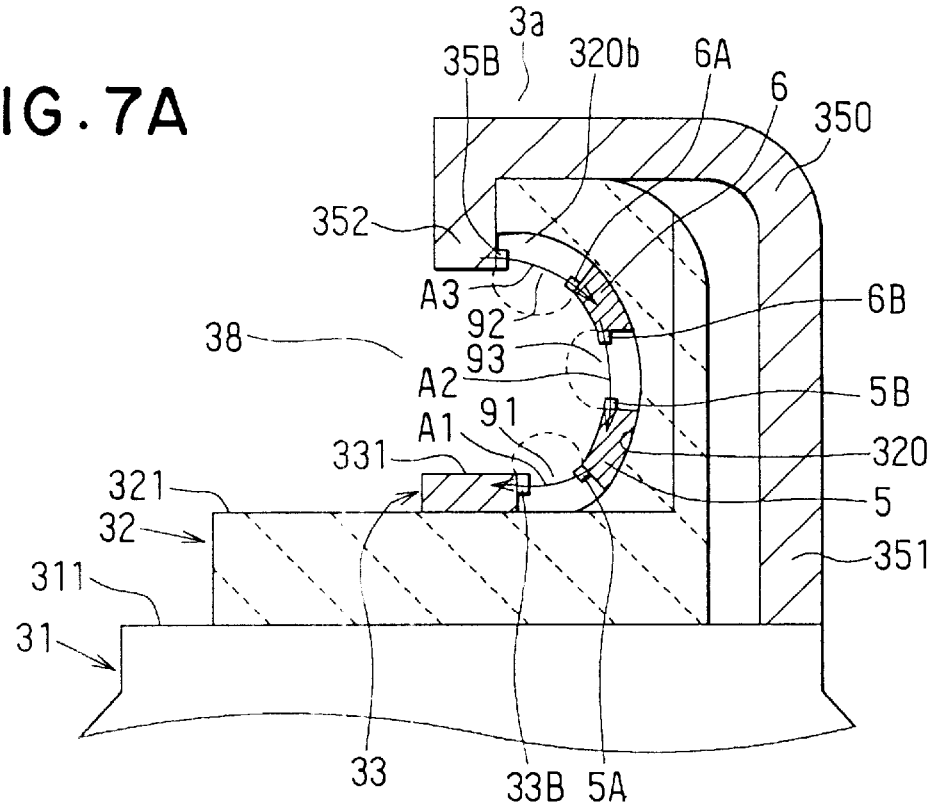
FIG. 7A is a sectional view of the ignition portion of the spark plug when a capacitive discharge occurs according to the fourth embodiment of the present invention.
Figure 7B:
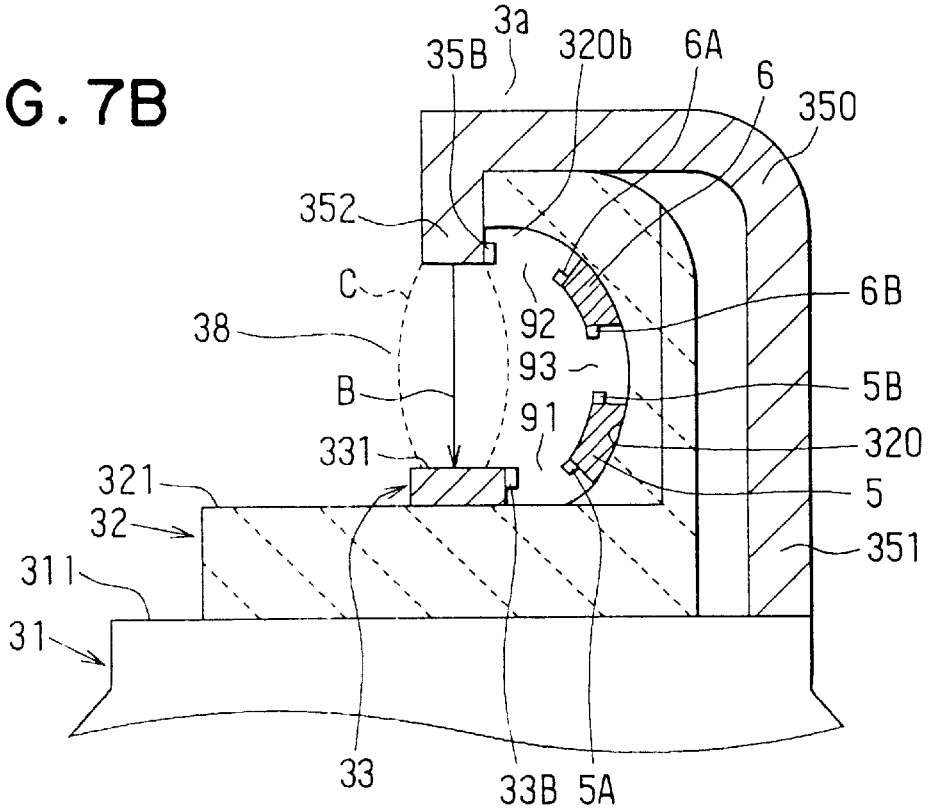
FIG. 7B is a sectional view of the ignition portion of the spark plug when a inductive discharge occurs according to the fourth embodiment of the present invention.

Thereby, voltage applied on the third bypass gap 93 is elevated and successively, as shown by an arrow mark A2 in FIG. 7A, capacitive discharge is carried out at the third bypass gap 93. Thereby, voltage applied on the second bypass gap 92 is elevated and accordingly, successively, as shown by an arrow mark A3 in FIG. 7A, capacitive discharge is successively carried out at the second bypass gap 92.

By the capacitive discharge, air at vicinities of the respective bypass gaps 91, 92 and 93 (that is, air present at spark gap 38) is subjected to insulation breakdown and ionized. Thereby, the electric resistance of the spark gap 38 becomes smaller than that of a path passing through the respective bypass gaps 91, 92 and 93 and accordingly, as shown by an arrow mark B in FIG. 7B, inductive discharge is carried out via the spark gap 38.

Further, the higher the temperature of the environment, the more liable the insulation breakdown by the capacitive discharge is caused and accordingly, the noble metal chips 33B, 35B, 5A, 5B, 6A and 6B are mounted on portions of the respective electrodes 33, 35, 5 and 6 on the side of the spark gap 38.

(Fifth Embodiment)

Figure 8:
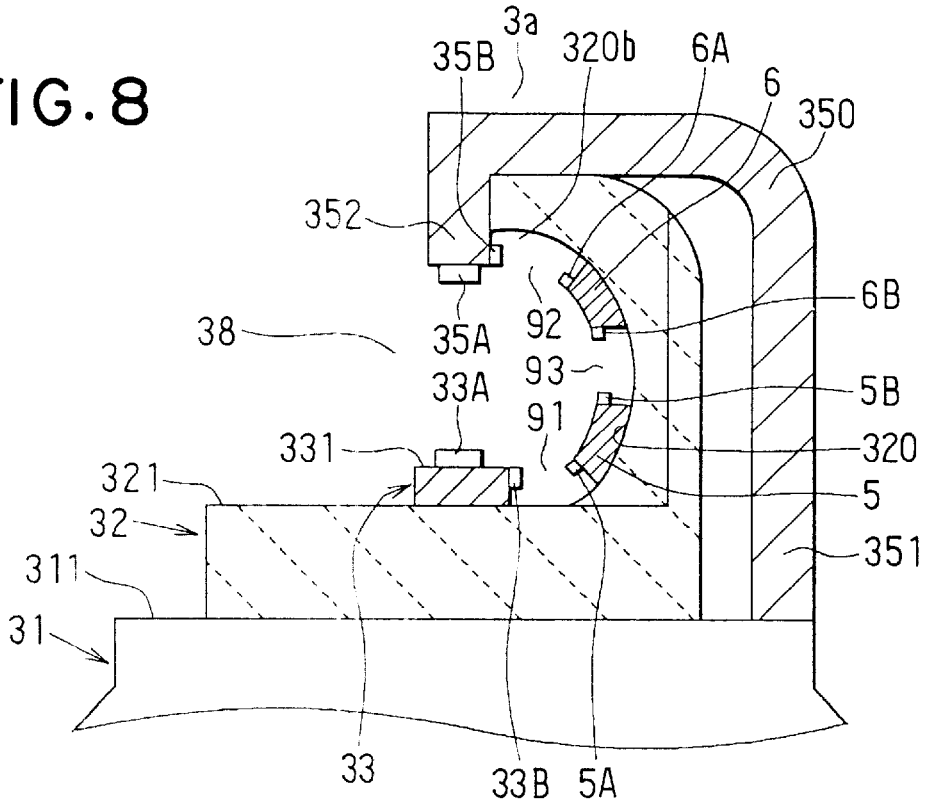
FIG. 8 is a sectional view of an ignition portion of a spark plug according to a fifth embodiment of the present invention.

According to this embodiment, the fourth embodiment mentioned above is modified and as shown by FIG. 8, the noble metal chips 33A and 35A are mounted on portions of the center electrode 33 and the ground electrode 35 which are opposed to the spark gap 38.

(Sixth Embodiment)

Figure 9:
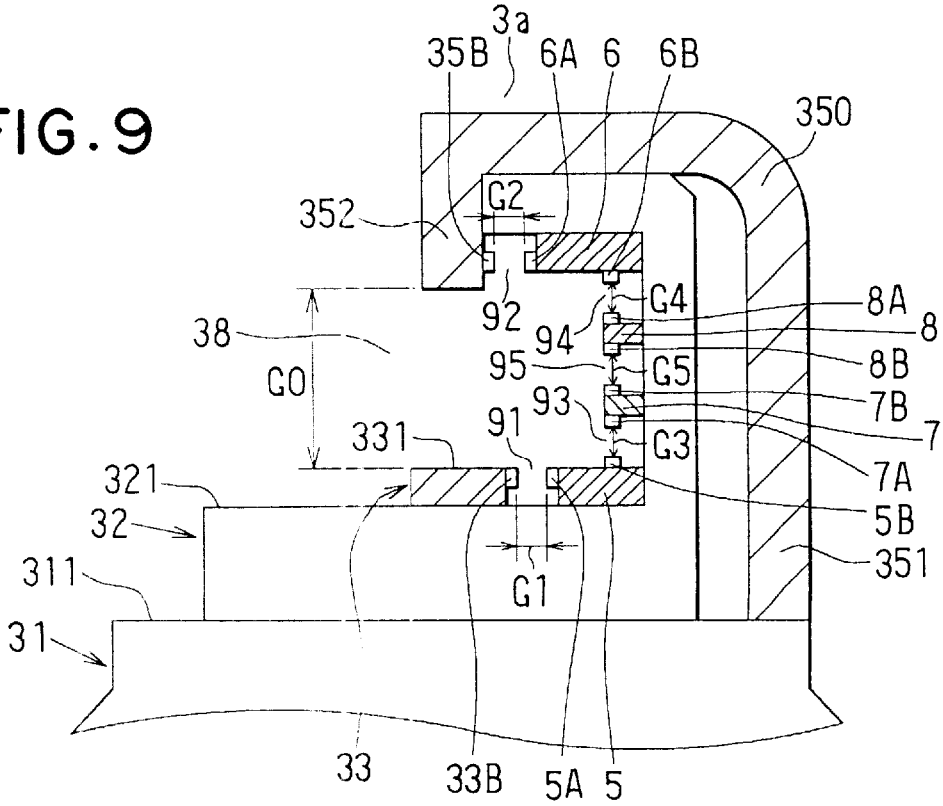
FIG. 9 is a sectional view of an ignition portion of a spark plug according to a sixth embodiment of the present invention.

According to this embodiment, the fourth embodiment mentioned above is modified and as shown by FIG. 9, a third bypass electrode 7 and a fourth bypass electrode 8 are installed between the first bypass electrode 5 and the second bypass electrode 6. Further, the third bypass electrode 7 is arranged to form a bypass gap 93 between the third bypass electrode 7 and the first bypass electrode 5, and the fourth bypass electrode 8 is arranged to form a bypass gap 94 between the fourth bypass electrode 8 and the first bypass electrode 5 and to form a bypass gap 95 between the fourth bypass electrode 8 and the third bypass electrode 7.

Further, the noble metal chip 5B is integrally mounted on a portion of the first bypass electrode 5 which is opposed to the bypass gap 93 and a noble metal chip 7A is integrally mounted on a portion of the third bypass electrode 7 which is opposed to the bypass gap 93. Further, the noble metal chip 6B is integrally mounted on a portion of the second bypass electrode 6 which is opposed to the bypass gap 94 and a noble metal chip 8A is integrally mounted on a portion of the fourth bypass electrode 8 which is opposed to the bypass gap 94. Further, a noble metal chip 7B is integrally mounted on a portion of the third bypass electrode 7 which is opposed to the bypass gap 95 and a noble metal chip 8B is integrally mounted on a portion of the fourth bypass electrode 8 which is opposed to the bypass gap 95.

Since the bypass gaps (93 through 95) are formed, a number of ionized portions is increased, and the electric resistance of the spark gap is reduced effectively.

In the embodiment, the capacitive discharge is carried out successively one by one from the closest bypass gap to the center electrode 33 among the respective bypass gaps 91 through 95.

Each of gap distances G1 through G5 of the bypass gaps 91 through 95 is made to be shorter than a gap distance G0 of the spark gap 38, and a total gap distance GA of the bypass gaps 91 through 95 is made longer than the gap distance G0 of the spark gap 38.

Furthermore, when each of the gap distances G1 through G5 of the bypass gaps 91 through 95 is excessively short, a short circuit may be caused by smoldering or the like. Therefore, each of the gap distances G1 through G5 may preferably be 0.5 mm or longer.

Meanwhile, when each of the gap distances G1 through G5 of the bypass gaps 91 through 95 is excessively long, breakdown voltage necessary for capacitive discharge becomes very large (for example, 30 kV or more). Therefore, each of the gap distances G1 through G5 may preferably be 1.5 mm or shorter.

(Seventh Embodiment)

Figure 10:
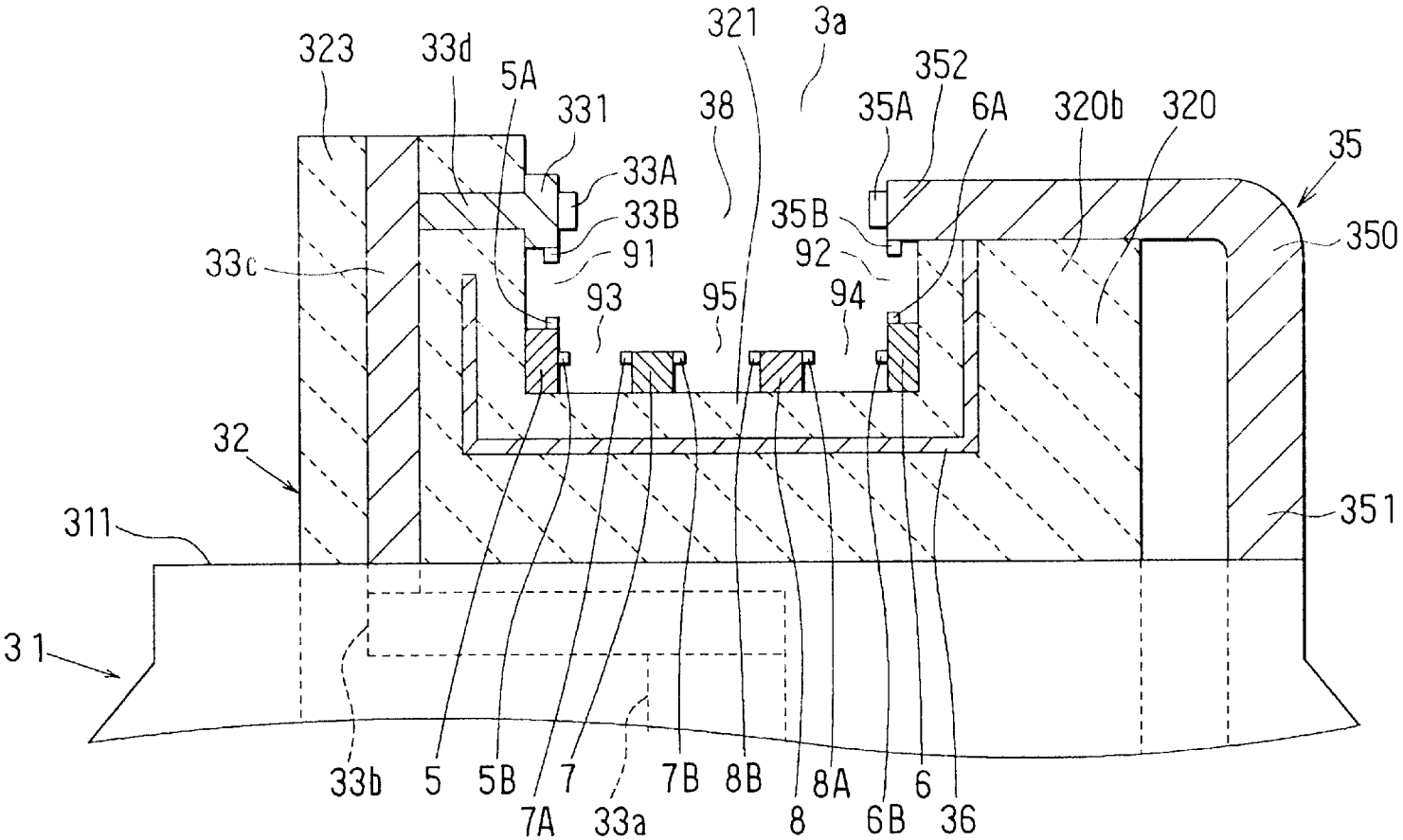
FIG. 10 is a sectional view of an ignition portion of a spark plug according to a seventh embodiment of the present invention.

According to this embodiment, the third embodiment and the sixth embodiment are combined, as shown by FIG. 10, the first, the second, the third and the fourth electrodes 5, 6, 7 and 8 comprising a conductive material are installed in faces of the one end portion 321 of the insulator 32 and the projected portions 320 and 323 which are opposed to the spark gap 38. Thereby, the first, the second, the third and the fourth bypass electrodes 5, 6, 7 and 8 are arranged along a path bypassing the spark gap 38.

Further, a conductive layer (extended portion of ground electrode in claims) 36 comprising a conductive material is built in the one end portion 321 and the projected portions 320 and 323 of the insulator 32. Further, all of distances between the conductive layer 36 and the bypass electrodes 5, 6, 7 and 8 are the same. Thereby, the conductive layer 36 is opposed to the bypass electrodes 5, 6, 7 and 8 via the insulator 32 and accordingly, condensers are formed by the conductive layer 36 and the bypass electrodes 5, 6, 7 and 8. Capacitance of the condensers are 5 times as much as or larger than capacitance of the gaps 91, 92, 93, 94 and 95 or more resulting in good effect and according to this embodiment, the multiplication factor is adjusted to 9.

At this point, explaining simply a method of fabricating the insulator 32 at a vicinity of the one end portion 321, firstly, the conductive layer 36 is formed in the insulator where the first through the fourth electrode portions 33*a*, 33*b*, 33*c* and 33*d* of the center electrode 33 are built in and thereafter, a separate insulator is fitted thereto to cover the conductive layer 36.

(Eighth Embodiment)

Figure 11:
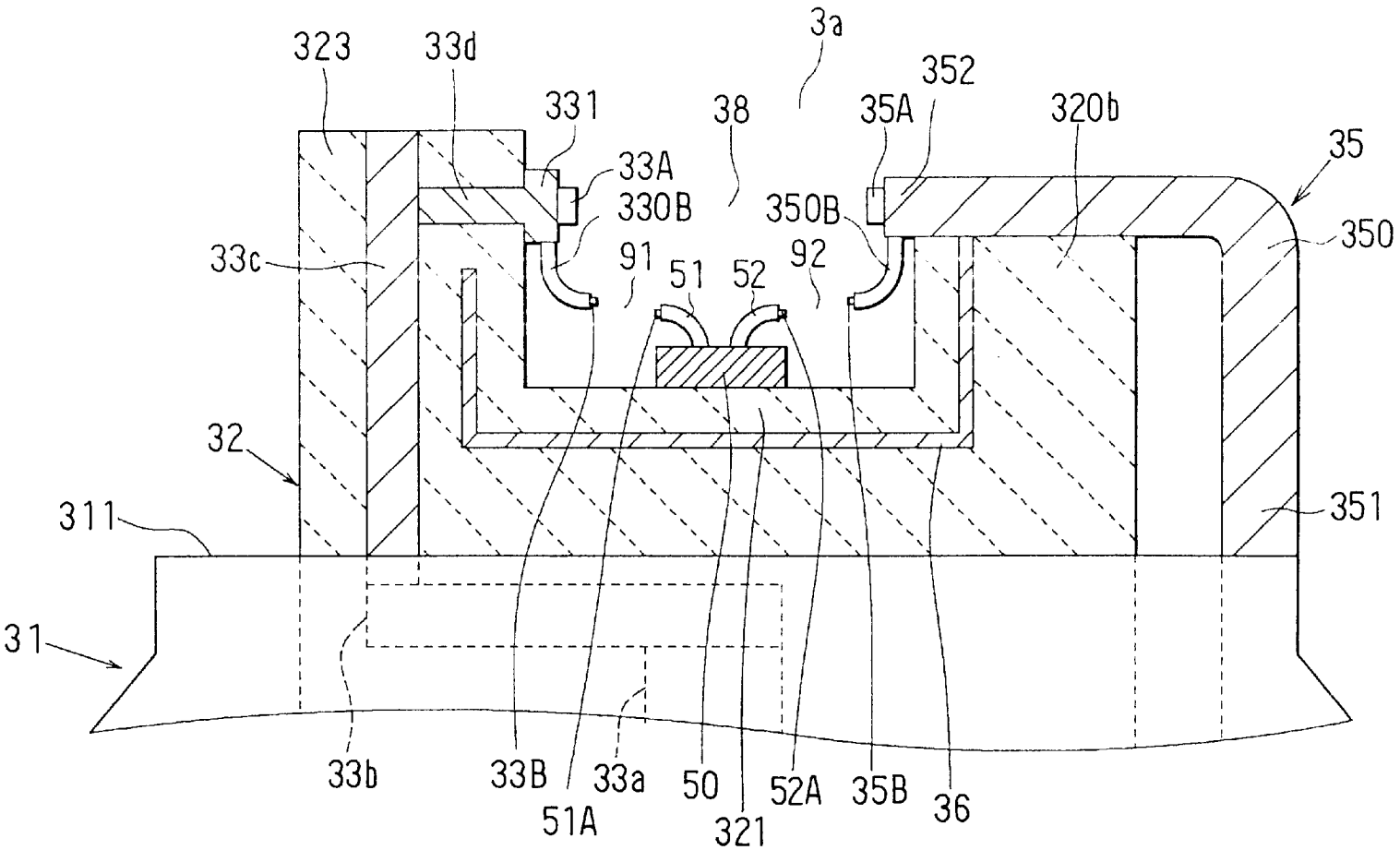
FIG. 11 is a sectional view of an ignition portion of a spark plug according to a eighth embodiment of the present invention.

According to this embodiment, the seventh embodiment is modified, as shown by FIG. 11, only one of a bypass electrode 50 is installed in a face of the one end portion 321 of the insulator 32 which is opposed to the spark gap 38. Further, a linear electrode portion 330B bent in a circular arc shape is integrally installed in the one end portion 331 of the intermediate electrode 33 by welding or the like and a linear electrode portion 350B bent in a circular arc shape is integrally installed in the other end portion 352 of the ground electrode 35. Further, linear electrode portions 51 and 52 bent in a circular arc shape are integrally installed in the bypass electrode 50. Further, a gap 91 is formed between the linear electrode portion 330B and the linear electrode portion 51 and a gap 92 is formed between the linear electrode portion 350B and the linear electrode portion 52.

Further, noble metal chips 33B and 51A are integrally mounted on portions of the linear electrode portion 330B and the linear electrode portion 51 which are opposed to the gap 91 and noble metal chips 35B and 52A are integrally mounted on portions of the linear electrode portion 350B and the linear electrode portion 52 which are opposed to the gap 92. In this case, the linear electrode portions 330B, 350B, 51 and 52 are arranged along a path bypassing the spark gap 38.

Further, the conductive layer 36 is opposed to the bypass electrode 50 and the linear electrode portions 51 and 52 via air (fuel) and the insulator 32 and accordingly, condensers are formed by the conductive layer 36 and the linear electrode portions 51 and 52. Capacitance of the condensers are 9 times as much as capacitance of the gaps 91 and 92.

Further, according to this embodiment, as shown by FIG. 11, even after assembling, the gap distances G1 and G2 of the gaps 91 and 92 can variously be changed by variously changing the circular arc shapes of the linear electrode portions 330B, 350B, 51 and 52.

Further, distances between the gaps 91, 92 and the insulator 32 can be made larger than those in the prior embodiments mentioned above. Therefore, the gaps 91 and 92 are disposed in a high temperature atmosphere, and insulation breakdown caused by capacitive discharge is facilitated.

(Ninth Embodiment)

Figure 12A:
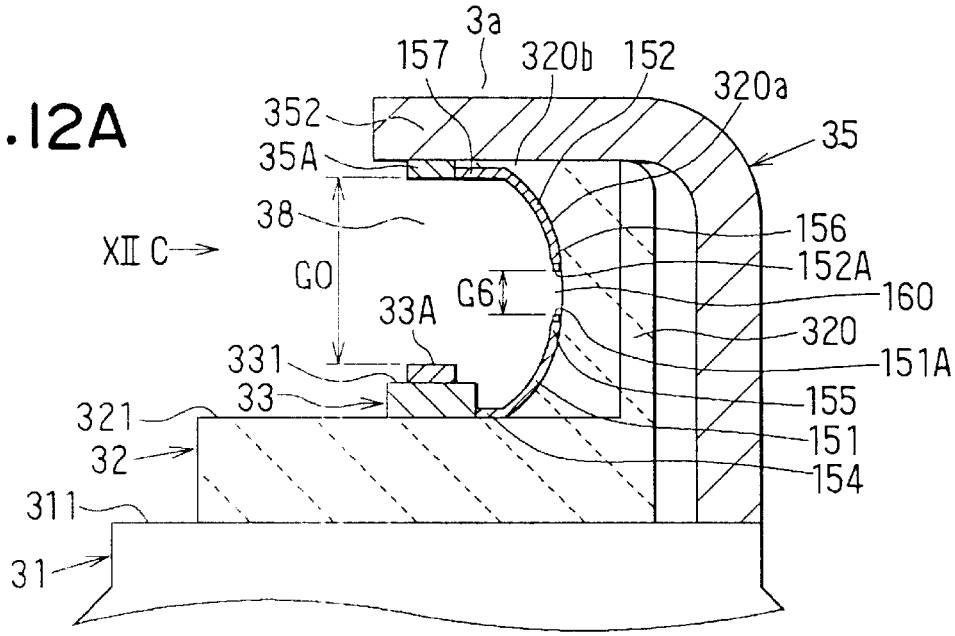
FIG. 12A is a sectional view of an ignition portion of a spark plug according to a ninth embodiment of the present invention.
Figure 12B:
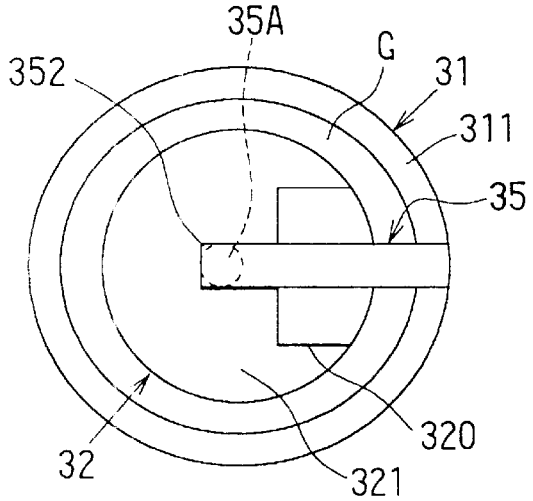
FIG. 12B is a plan view of the ignition portion of the spark plug according to the ninth embodiment of the present invention.
Figure 12C:
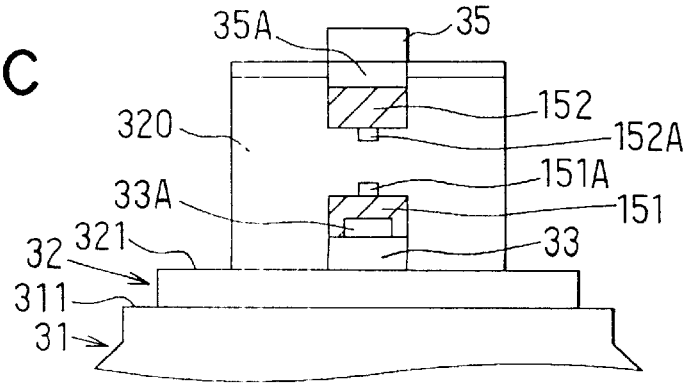
FIG. 12C is a front view of the ignition portion of the spark plug according to the ninth embodiment, viewed from an arrow XIIC.

The ninth embodiment is shown by FIGS. 12A, 12B and 12C. According to this embodiment, the first embodiment is modified, in FIGS. 12A, 12B and 12C, FIG. 12A is a sectional view of an ignition unit of a spark plug, FIG. 12B is a top view of FIG. 12A, and FIG. 12C is a drawing viewing FIG. 12A in an arrow mark XIIC direction. Although hatching is given to bypass electrodes 151 and 152 in FIG. 12C, FIG. 13C and FIG. 14C, mentioned later, for convenience of explanation, the hatching indicates not the section but the outlook.

As shown by FIGS. 12A, 12B and 12C, the first and the second bypass electrodes 151 and 152 comprising a semiconductor material are installed in the face 320*a* of the projected portion 320 of the insulator 32 on the side of the spark gap 38. Further, the front end portion 320*b* of the projected portion 32 is extended to a position opposed to the center electrode 33 and the front end portion 320*b* is covered with the other end portion 352 of the ground electrode 35.

One end portion 154 of the first bypass electrode 151 is electrically connected to the one end portion 331 of the center electrode 33 and other end portion 155 of the first bypass electrode 151 forms a bypass gap 160 between the other end portion 155 and one end portion 156 of the second bypass electrode 152. Further, other end portion 157 of the second bypass electrode 152 is electrically connected to the ground electrode 352. In other words, according to the embodiment, a bypass gap is formed in the spark plug shown by FIG. 2 by separating a middle portion of the bypass electrode 4.

A gap distance G6 of the bypass gap 160 is shorter than the gap distance G0 of the spark gap 38 and is set to 1.5 mm through 3.0 mm. That is, for example, in the case of the gap distance G0 of 2.0 mm, the gap distance G6 is set to a distance shorter than 2.0 mm, for example, 1.7 mm. It is preferable that the gap distance G6 is between 0.5 mm and 3.0 mm including 0.5 mm and 3.0 mm.

Furthermore, noble metal chips 151A and 152A are integrally mounted on portions of the first bypass electrode 151 and the second bypass electrode 152 which are opposed to the bypass gap 160, respectively.

Figure 13A:
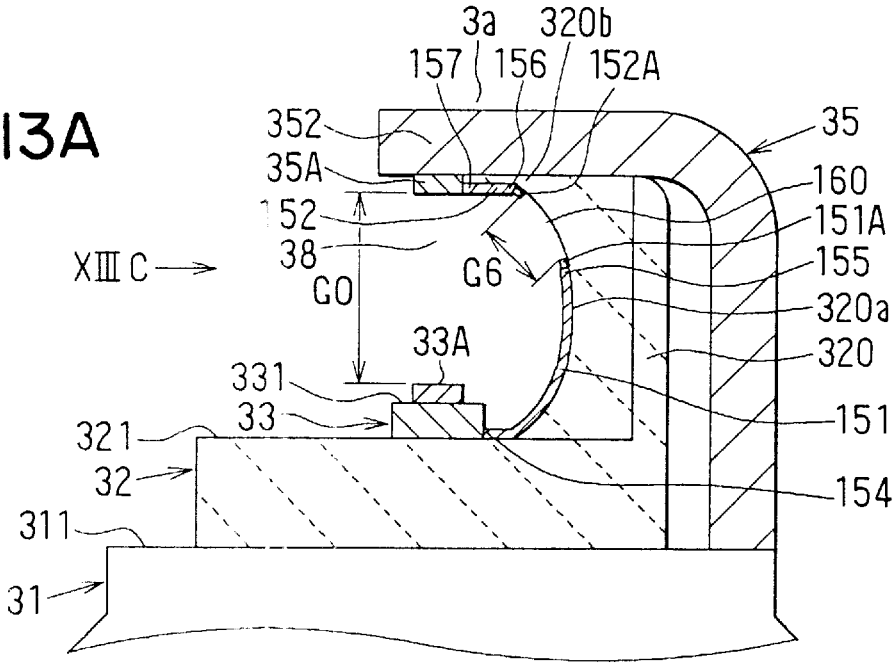
FIG. 13A is a sectional view of an ignition portion of a spark plug according to a first modification of the ninth embodiment of the present invention.
Figure 13B:
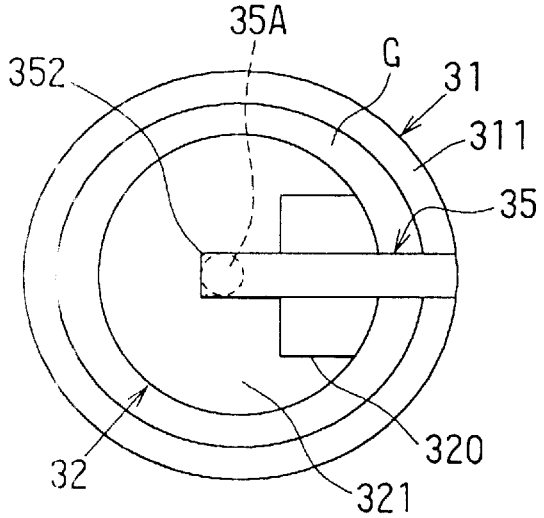
FIG. 13B is a plan view of the ignition portion of the spark plug according to the first modification of the ninth embodiment of the present invention.
Figure 13C:
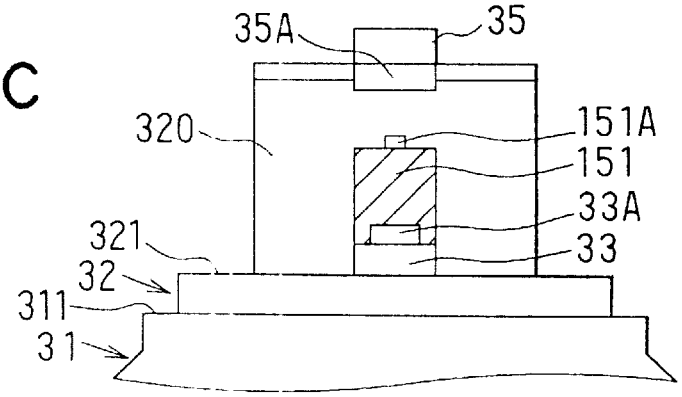
FIG. 13C is a front view of the ignition portion of the spark plug according to the first modification of the ninth embodiment, viewed from an arrow XIIIC.
Figure 14A:
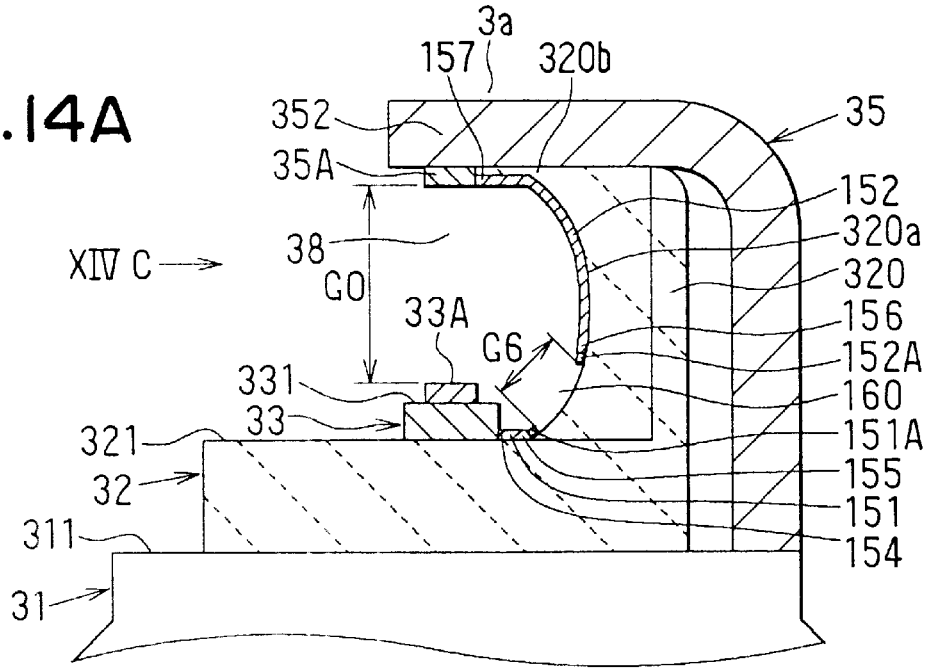
FIG. 14A is a sectional view of an ignition portion of a spark plug according to a second modification of the ninth embodiment of the present invention.
Figure 14B:
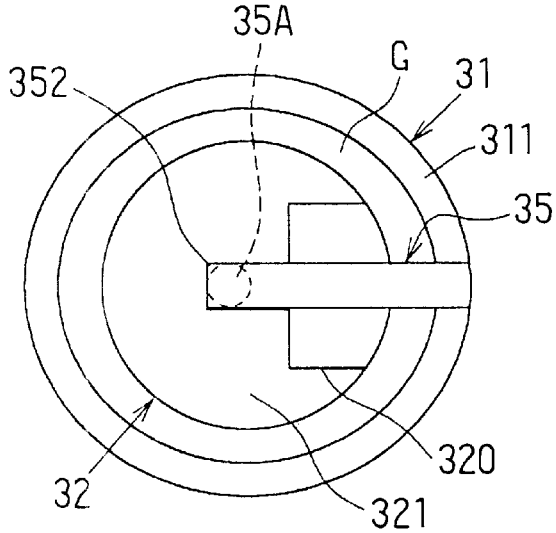
FIG. 14B is a plan view of the ignition portion of the spark plug according to the second modification of the ninth embodiment of the present invention.
Figure 14C:
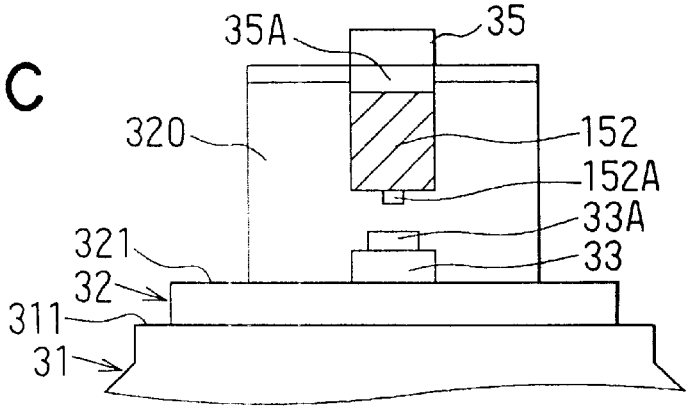
FIG. 14C is a front view of the ignition portion of the spark plug according to the second modification of the ninth embodiment, viewed from an arrow XIVC.

A first modified example of the ninth embodiment is shown in FIGS. 13A, 13B and 13C, and a second modified example is shown in FIGS. 14A, 14B and 14C.

According to the both modified examples, in comparison with FIGS. 12A, 12B and 12C, the position of installing the bypass gap 160 is changed. According to the first modified example shown by FIGS. 13A, 13B and 13C, the position is shifted to the side of the ground electrode 352 compared with the spark plug shown by FIGS. 12A, 12B and 12C and according to the second modified example shown by FIGS. 14A, 14B and 14C, the position is shifted to the side of the center electrode 33 compared with the spark plug shown by FIGS. 12A, 12B and 12C and other constitutions are the same as those in FIGS. 12A, 12B and 12C.

Figure 15A:
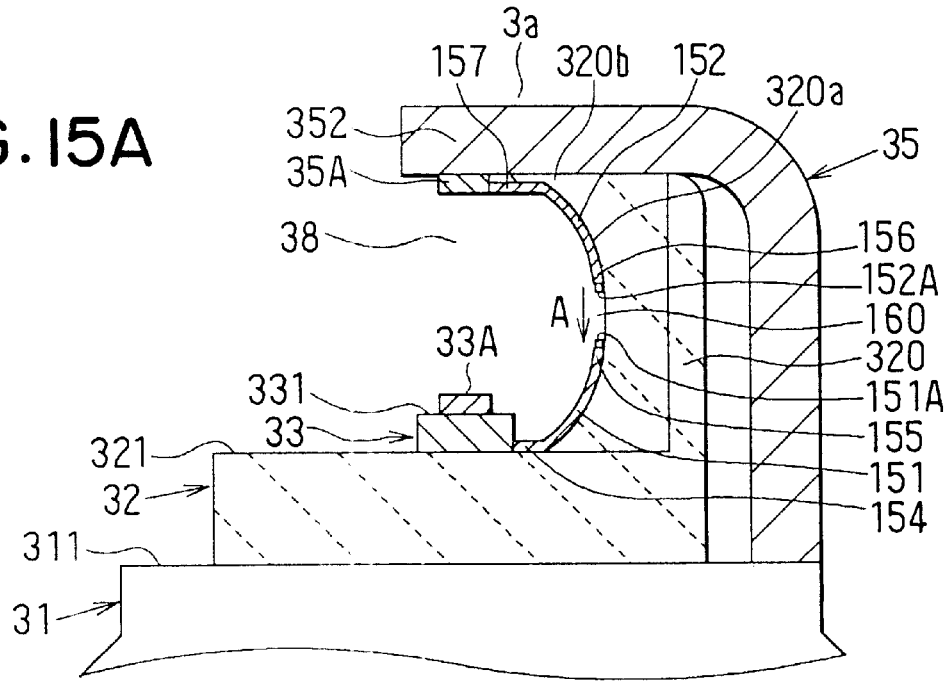
FIGS. 15A and 15B are sectional views of the ignition portion of the spark plug according to the ninth embodiment to explain its operations.
Figure 15B:
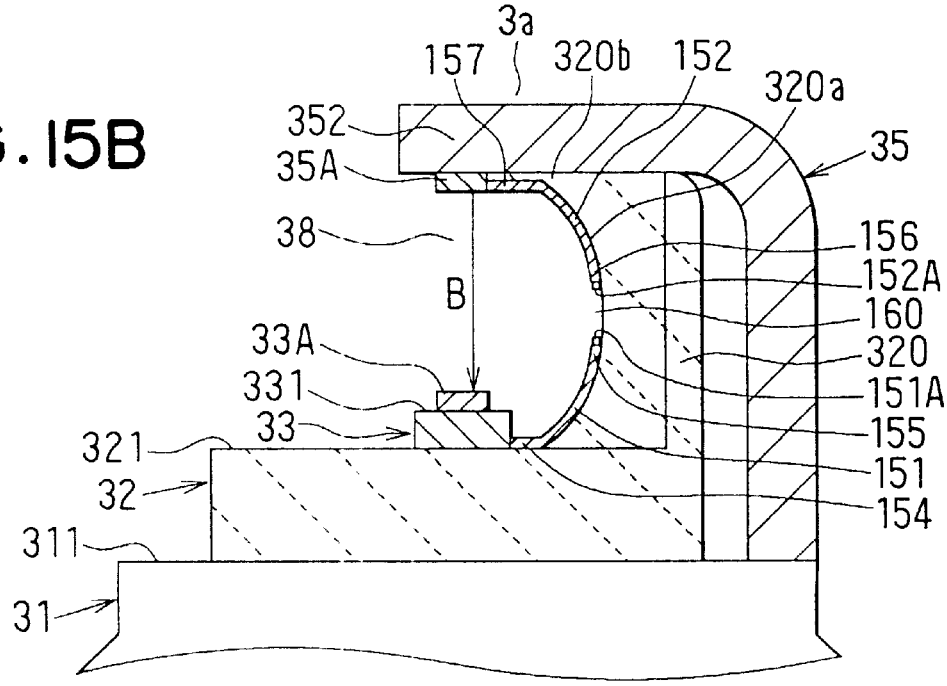

An explanation will be given of the operation according to the embodiment in reference to FIGS. 15A and 15B. FIGS. 15A and 15B are explanatory views of the operation based on the constitution of the spark plug shown by FIGS. 12A, 12B and 12C and the operation is carried out similarly also in the respective modified examples shown by FIGS. 13A, 13B and 13C and FIGS. 14A, 14B and 14C.

First, when high voltage is applied on the center electrode 33, voltage applied at the bypass gap 160 formed by the both bypass electrodes 151 and 152 connected to the ground electrode 35 and the center electrode 33 is elevated and accordingly, as shown by an arrow mark A in FIG. 15A, capacitive discharge is carried out at the bypass gap 160. Thereby, air at a vicinity of the bypass gap G6 is subjected to insulation breakdown and ionized.

In this case, at the same time, although air at a vicinity of the surface of the electrode is ionized by conducting electricity to the bypass electrodes 151 and 152 comprising a semiconductor material, effective ionization is carried out by discharging free electrons from the semiconductor and accordingly, a degree of ionization is far larger than the ionization at the bypass gap 160 mentioned above.

Thereby, the electric resistance of the spark gap 38 between the center electrode 33 and the ground electrode 352 becomes smaller than the electric resistance combined with electric resistances of the first bypass electrode 151 and the second bypass electrode 152 and electric resistance of the bypass gap 160 and accordingly, as shown by an arrow mark B of FIG. 15B, inductive discharge is carried out via the spark gap 38. Accordingly, also according to this embodiment, a spark plug promoting ignition performance while lowering breakdown voltage can be provided.

(Tenth Embodiment)

Figure 16:
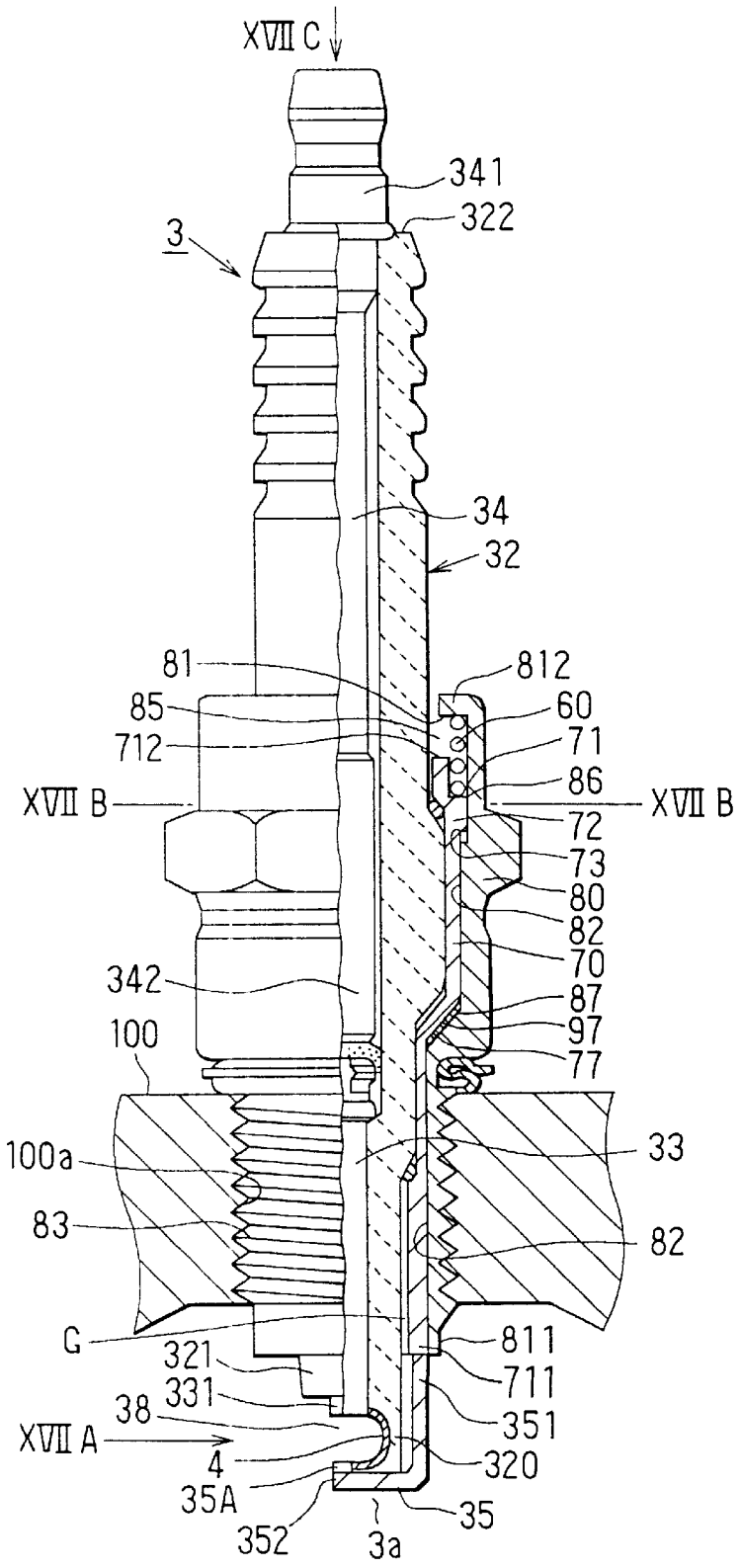
FIG. 16 is a partially sectional view of a spark plug according to a tenth embodiment of the present invention.

A tenth embodiment is shown in FIGS. 16 through 18. According to the tenth embodiment, in respect of the spark plug shown by FIG. 1, the attachment metal piece, that is, the main body metal piece is formed by two separate parts which are engaged with each other and is mainly featured in that by adjusting a positional relationship between the two main body metal pieces in a state where the engagement is released, the ground electrode and the bypass electrode can be directed in desired directions in a cylinder of an engine.

Figure 17A:
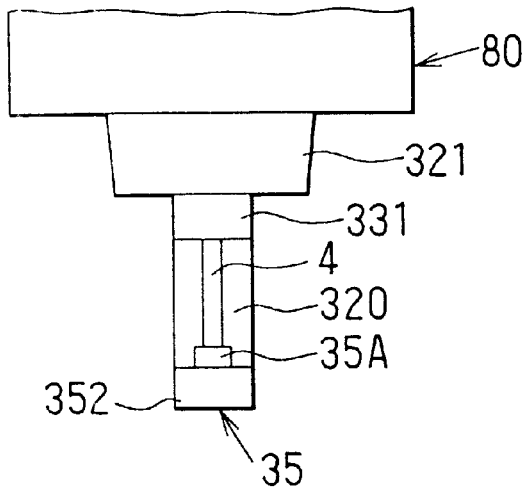
FIG. 17A is a partial front view of the spark plug according to a tenth embodiment of the present invention, viewed from an arrow XVIIA.

An ignition unit of a spark plug 3 according to the embodiment is shown by FIG. 17A which is a drawing viewed FIG. 16 in an arrow mark XVIIA direction. Further, although respective sizes and shapes of the bypass electrode 4 and the projected portion 320 of the insulator 32 are more or less different from those of FIG. 2, the basic structure substantially stays the same. Further, although according to the embodiment, the noble metal chip 33A is not provided, it may be provided.

Further, constitutions of the insulator 32, the center electrode 33 and the stem portion (shaft portion) 34 are provided with structures the same as those in FIG. 1. A description will mainly be given of portions different from those of the spark plug 3 of FIG. 1 as follows, the same portions are attached with the same notations in the drawings and an explanation thereof will be omitted.

Also in FIG. 16, similar to FIG. 1, the spark plug 3 is mounted to the engine block of an engine. Numeral 70 designates a first main body metal piece (first attachment metal piece) which is arranged on the outer periphery of the insulator 32 and which fixes the insulator 32 by thermal caulking, cold caulking or the like and supports the insulator 32.

Hereinafter, according to this embodiment, the up and down direction is referred to as up and down direction in FIG. 16.

The first main body metal piece 70 incorporates and holds the center electrode 33, the stem portion 34 and the insulator 32 at inside thereof. Similar to FIG. 1, one end portion (lower side end portion) 711 of the first main body metal piece 70 is fixed with the other end portion 352 of the ground electrode 35 to be opposed to the front end portion 331 of the center electrode 33 via the spark gap 38.

Further, the one end portion 321 and the other end portion 322 of the insulator 32 are exposed from the one end portion 711 and other end portion (upper side end portion) 712 of the first main body metal piece 70 and the side of the one end portion 321 of the insulator 32 and the side of the one end portion 711 of the first main body metal piece 70 are arranged via the gap volume G in the diameter direction.

Numeral 80 designates a second main body metal piece (second attachment metal piece) in a cylindrical shape which is arranged on the outer periphery of the first main body metal piece 70 separately from the first main body metal piece 70. A guide hole 82 is formed at inside of the second main body metal piece 80 and the first main body metal piece 70 and the insulator 32 are incorporated in and held by the guide hole 82.

The inner diameter of the guide hole 82 is made larger than the outer diameter of the insulator 32 and the outer periphery of the first main body metal piece 70 and the inner periphery of the guide hole 82 are arranged via a very small clearance such that the first main body metal piece 70 and the insulator 32 are rotatable in the peripheral direction.

One end portion (lower side end portion) 811 of the second main body metal piece 80 coincides with the one end portion (lower side end portion) 711 of the first main body metal piece 70. Meanwhile, the other end portion (upper side end portion) 712 of the first main body metal piece 70 is incorporated in the second main body metal piece 80 and other end portion (upper side end portion) 812 of the second main body metal piece 80 is disposed above the other end portion 712 of the first main body metal piece 70.

Further, a spring (spring member) 60 is installed between the other end portion 712 of the first main body metal piece 70 and the other end portion 812 of the second main body metal piece 80 in contact with the both end portions 712 and 812 and the spring 60 is extractable and detractable in the central axis direction of the two main body metal pieces 70 and 80, that is, in the up and down direction. Normally, as shown by FIG. 16, the spring 60 exerts downward load on the first main body metal piece 70 such that a gap 85 is present between the two end portions 712 and 812.

In this case, in the lower end portion 712 of the first main body metal piece 70, a portion in contact with the spring 60, forms a seat face 71 positioning the lower end of the spring 60. Meanwhile, in the other end portion 812 of the second main body metal piece 80, a portion in contact with the spring 60 forms a seat face 81 for positioning the upper end of the spring 60. Further, the guide hole 82 is formed in a shape where the first main body metal piece 70 can be elevated until portions of the spring 60 are brought into close contact with each other.

Figure 17B:
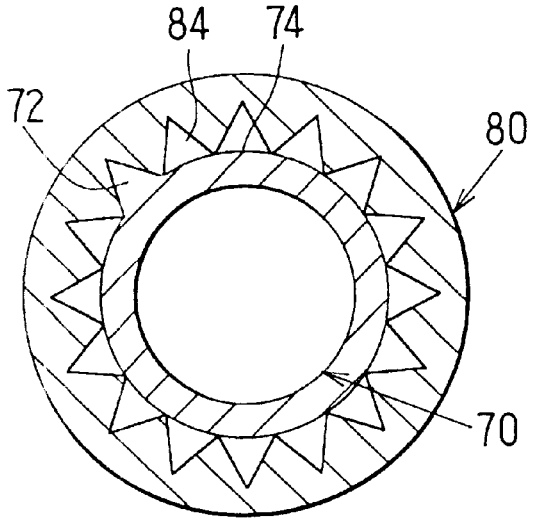
FIG. 17B is a sectional view taken along a line XVIIB—XVIIB of FIG. 16 according to the tenth embodiment of the present invention.

FIG. 17B shows a sectional view taken along a line XVIIB—XVIIB of FIG. 16. Further, in FIG. 17B, only the first main body metal piece 70 and the second main body metal piece 80 are shown and the insulator 32 and the stem portion 34 are omitted.

As shown by FIG. 17B, a projection (projected portion) 72 is formed on an outer diameter face 74 below the seat face 71 in the outer peripheral portion of the first main body metal piece 70. Further, a plurality of notches (recess portions) 84 constituting the same shape of the section are formed at every very small angle of 10 through 45° over an entire periphery in the middle portion of the inner peripheral face of the guide hole 82. In this case, one or more of the projections 72 of the first main body metal piece 70 with a sectional shape coinciding with the shape of the notches 84, are installed.

According to this embodiment, an engagement mechanism is formed by the spring 60, the projections 72, the notches 84 and the guide hole 82.

Further, on the lower side of the outer peripheral portion of the second main body metal piece 80, a screw thread (fastening portion) 83 for mounting the spark plug 3 to the screw thread 100*a* of the engine block 100 attachably and detachably, is formed. The screw thread 83 is provided with a function similar to that of the screw thread 31*a* in FIG. 1.

Figure 18A:
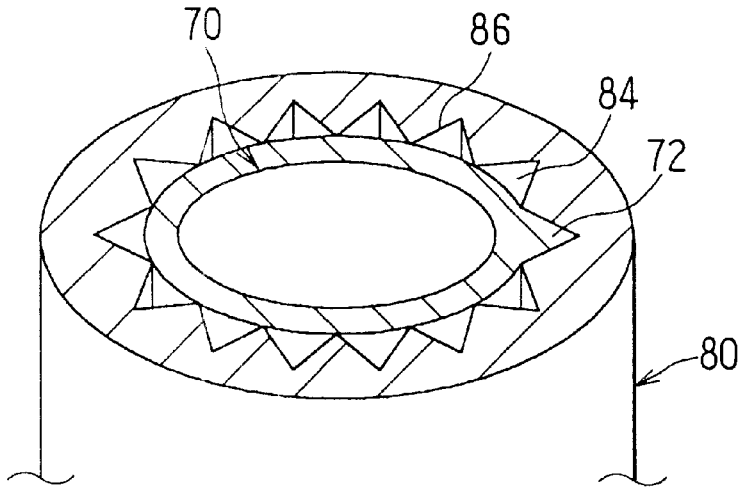
FIGS. 18A and 18B are schematic views to explain its operations of an engagement mechanism of the tenth embodiment of the present invention.
Figure 18B:
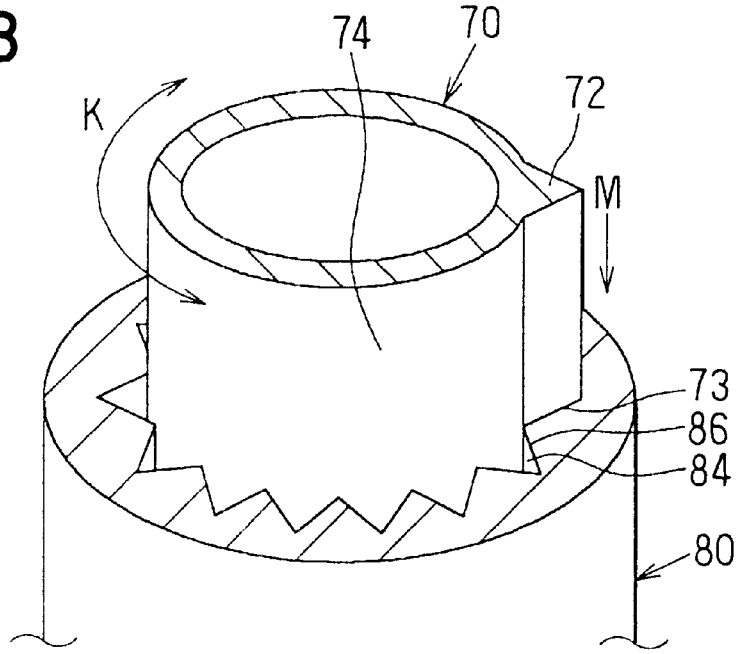

FIGS. 18A and 18B are explanatory views showing the operation of the engagement mechanism according to the embodiment showing section XVIIB—XVIIB of FIG. 17B in a skewed direction. Further, also in FIGS. 18A and 18B, similar to FIG. 17B, only the first main body metal piece 70 and the second main body metal piece 80 are shown.

FIG. 18A shows a state where the first main body metal piece 70 is mostly lowered in the second main body metal piece 80, that is, the guide hole 82 by downward load of the spring 60 (the state is referred to as a first predetermined position). At the first predetermined position, the projection 72 coincides with the notch 84, the both main body metal pieces 70 and 80 are engaged with each other and are prevented from being rotated in the circumferential direction. Incidentally, FIG. 16 shows a state of the first predetermined position.

Further, FIG. 18B shows a state where the first main body metal piece 70 is elevated in respect of the second main body metal piece 80 in the central axis direction by contracting the spring 60 and a lower end portion 73 of the projection 72 is disposed above an upper end portion 86 of the notch 84 (the state is referred to as a second predetermined position). At the second predetermined position, the engagement is released and the first main body metal piece 70 and the insulator 32 are rotatable in the circumferential direction (refer to arrow mark K in FIG. 18B).

Further, a shoulder portion 77 of the first main body metal piece 70 and a shoulder portion 87 of the second main body metal piece 80 are prevented from being brought into contact with each other by a seal member 97 and the inside of the cylinder of the engine can be maintained in airtight.

Figure 17C:
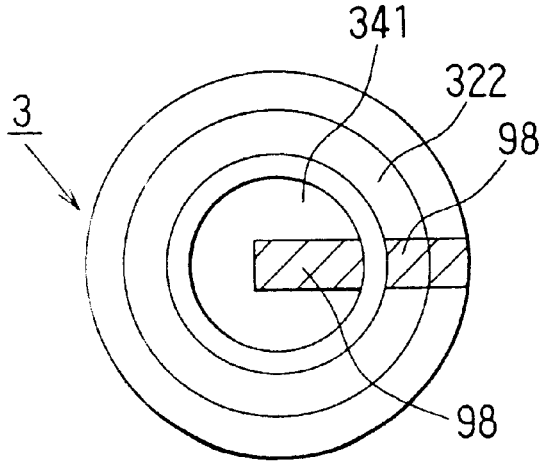
FIG. 17C is a plan view of the spark plug according to the tenth embodiment, viewed from an arrow XVIIC.

Further, as shown by FIG. 16, a portion of the stem portion 34 disposed at the central axis of the spark plug 3 is exposed from the other end portion 322 of the insulator 32. Here, FIG. 17C is a drawing viewing FIG. 16 in an arrow mark XVIIC direction. A mark (mark portion) 98 is provided by printing or projecting it at both of the other end portion 322 of the insulator 32 and an exposed portion 341 and is in correspondence with the direction of the ground electrode 35. In the drawing, the mark 98 is indicated by hatching for convenience of explanation.

Incidentally, the mark 98 may be provided on the surface directed upwardly of at least one of the exposed portion 341 of the stem portion 34 and the other end portion 322 of the insulator such that it can be optically recognized.

By such a constitution, as shown by the following procedure, the ground electrode 35 and the bypass electrode 4 can be directed in desired directions in the cylinder of the engine by adjusting the positional relationship between the two main body metal pieces 70 and 80.

First, the spark plug 3 is fixed to the engine 100 by the screw 83 of the second main body metal piece 80 such that an amount of projecting the plug into the cylinder of the engine is set to a prescribed amount. Successively, the first main body metal piece 70 is moved upwardly to the position where the coincidence between the projection 72 and the notch 84 is released (second predetermined position) as shown by FIG. 18B against the downward load of the spring 60 by using a tool or the like capable of pulling up the first main body metal piece 70 in the upward direction by supporting a projected portion of a corrugated portion or the like in the insulator 32.

Further, the first main body metal piece 70 is rotated in the arrow mark K direction shown by FIG. 18B by a very small angle such that the projection 70 and the notch 84 are in mesh with each other while making the direction of the ground electrode 35 coincide with the engine by optically recognizing by the mark 95. Thereafter, the first main body metal piece 70 is again lowered in an arrow mark M direction shown by FIG. 18B down to the prescribed plug projecting position mentioned above by which the ground electrode 35 and the bypass electrode 4 can be directed in predetermined directions in the cylinder of the engine 100.

Further, in a normal state other than adjusting direction, the both main body metal pieces 70 and 80 in the spark plug 3 are brought into the engaged state, that is, disposed at the first position by the load of the spring 60 in the downward direction of FIG. 16.

Thereby, in the spark plug 3 where discharge spark is formed in a face including the central axis and the bypass electrode 4, directions of the respective electrodes 4 and 35 in the cylinder can be adjusted such that the face of forming the plug is orthogonal to a direction of flying (flowing) the mixture and the ignition performance can significantly be promoted even in stratified charge combustion or the like. Further, with regard to adjusting directions of the respective electrodes 4 and 35, the adjustment can be carried out while maintaining the amount of projecting the plug into the cylinder constant.

According to this embodiment, a mark portion 98 indicating the direction of the ground electrode 35 is provided at at least one of the shaft portion 34 and the insulator 32 such that it can be recognized optically. Accordingly, the adjustment of the direction can be carried out while confirming the direction of the ground electrode 35 in the cylinder of the engine.

(Eleventh Embodiment)

Figure 19:
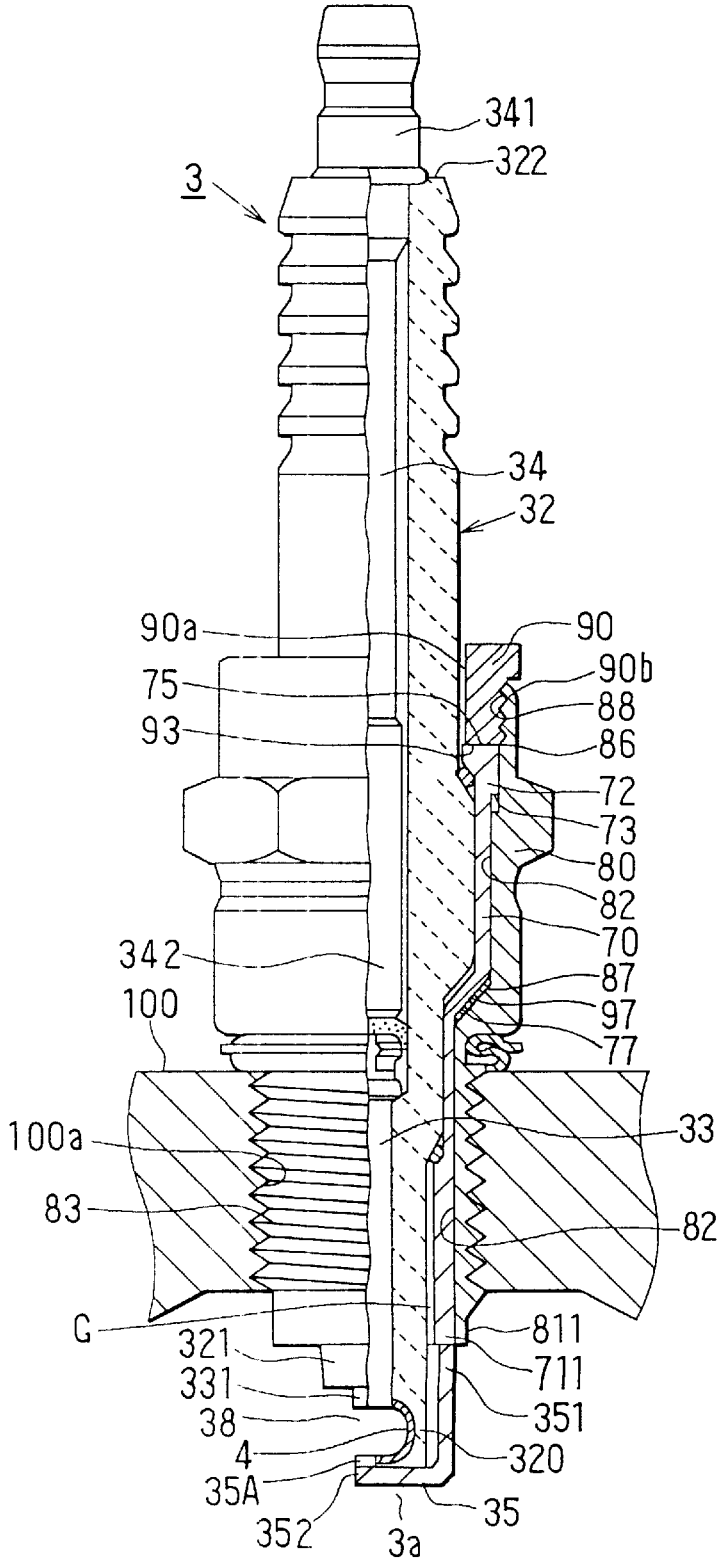
FIG. 19 is a partially sectional view of a spark plug according to an eleventh embodiment of the present invention.

An eleventh embodiment is shown in FIG. 19. In contrast to the tenth embodiment where the first main body metal piece 70 is brought into close contact with the second main body metal piece 80 by load (elastic force) of the spring 60 and the engaged state is maintained, this embodiment is provided with a structure where the close contact is carried out by a fastening bolt (fastening member) 90.

Therefore, according to this embodiment, the tenth embodiment mentioned above is modified, hereinafter, a description will mainly be given of portions different from the tenth embodiment and an explanation will be omitted with respect to the same portions. Further, in the following, the up and down direction in this embodiment indicates up and down direction in FIG. 19.

In the first main body metal piece 70 having the ground electrode 35 at its bottom face (lower side end face), a contact face 75 in contact with a bottom face 93 of the fastening bolt 90 is formed at its upper end face. Further, similar to the tenth embodiment, the projection (projected portion) 72 is formed on the outer peripheral face 74 below the contact face 75 in the outer peripheral portion of the first main body metal piece 70.

The fastening bolt 90 is provided with a guide hole 90*a* having the inner diameter larger than the outer diameter of the insulator 32 and is provided with a screw 90*b* at the lower portion on the outer peripheral side face. Further, the insulator 32 is inserted into the guide hole 90*a* and the fastening bolt 90 is able to pivot around the outer periphery of the insulator 32.

Similar to the tenth embodiment, the second main body metal piece 80 is provided with the screw 83 and the guide hole 82. Further, different from the tenth embodiment, in the second main body metal piece 80, a screw 88 engaged with the fastening bolt 90 is formed on the inner peripheral face of the upper portion in place of the seat face 81. Further, the notches 84 are formed on the inner peripheral face at the middle of the guide hole 82 below the screw 88.

According to this embodiment, an engagement mechanism is formed by the fastening bolt 90, the projection 72, the notches 84 and the guide hole 82. Operation thereof is carried out similarly to the operation shown by FIGS. 18A and 18B by fastening the fastening bolt 90.

That is, by downward load by fastening the fastening bolt 90, the first main body metal piece 70 is brought into a state where it is mostly lowered in the second main body metal piece 80, that is, the first main body metal piece 70 is disposed at the first predetermined position and the engagement state is produced by making the projection 72 coincide with the notch 84. The fastening bolt 90 is slackened to a degree where it is not detached from the second main body metal piece 80, the first main body metal piece 70 is elevated from the first predetermined position and the lower end 73 of the projection 72 is disposed above the upper end 86 of the notch 84 and the first main body metal piece 70 is disposed at the second predetermined position.

In this case, the fastening bolt 90 is fastened or slackened by using a tool or the like capable of pulling up the first main body metal piece 70 by supporting a projected portion of a corrugated portion or the like of the insulator 32.

In this way, also in this embodiment, an effect similar to that of the tenth embodiment can be achieved.

(Twelfth Embodiment)

A specific constitution of a spark plug according to this embodiment is shown by FIGS. 20, 21A, 21B, 22A, 22B, 23, 24A and 24B. In this case, FIG. 20 and FIGS. 21A and 21B indicate a first example, FIGS. 22A and 22B indicate a second example and FIG. 23 and FIGS. 24A and 24B indicate a third example.

According to this embodiment, in the spark plug 3 shown in the first embodiment, the structure of the ignition unit 3*a* which is inserted into the combustion chamber R is changed, a ground electrode 600 is arranged in a circumferential (ring) shape centering on the center electrode 33, a bypass electrode 900 is arranged in a circumferential (ring) shape in correspondence with the ground electrode 600 between the center electrode 33 and the ground electrode 600, which is a main point of difference from FIG. 1. Incidentally, portions the same as those in the first embodiment are attached with the same notations in FIGS. 20, 21A, 21B, 22A, 22B, 23, 24A and 24B.

Figure 20:
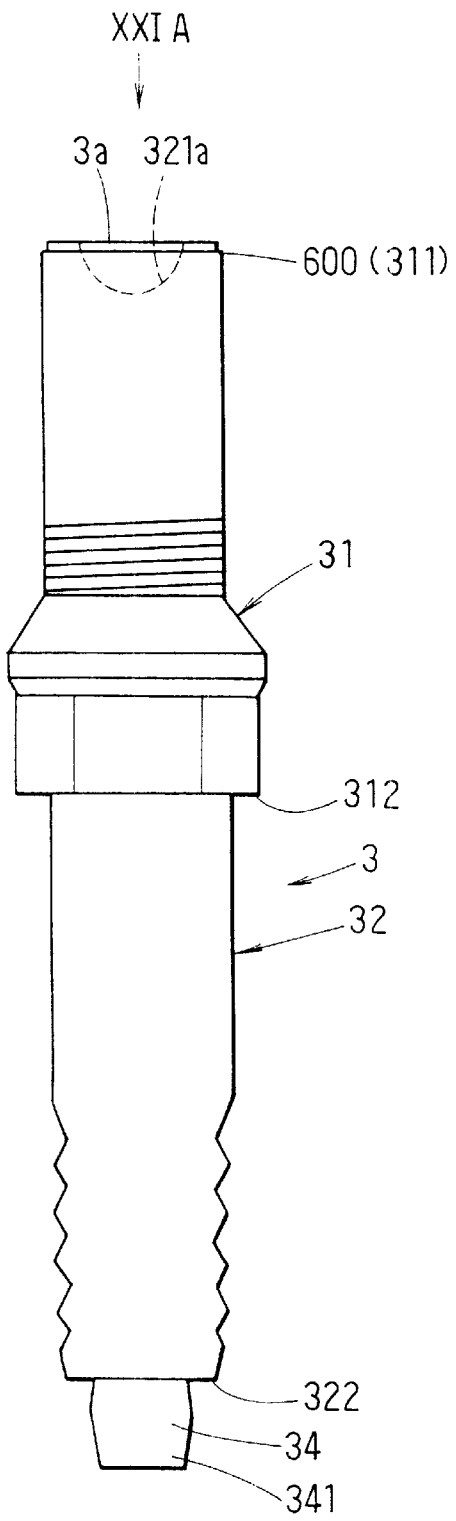
FIG. 20 is a front view of a spark plug according to a first example of a twelfth embodiment of the present invention.
Figure 21A:
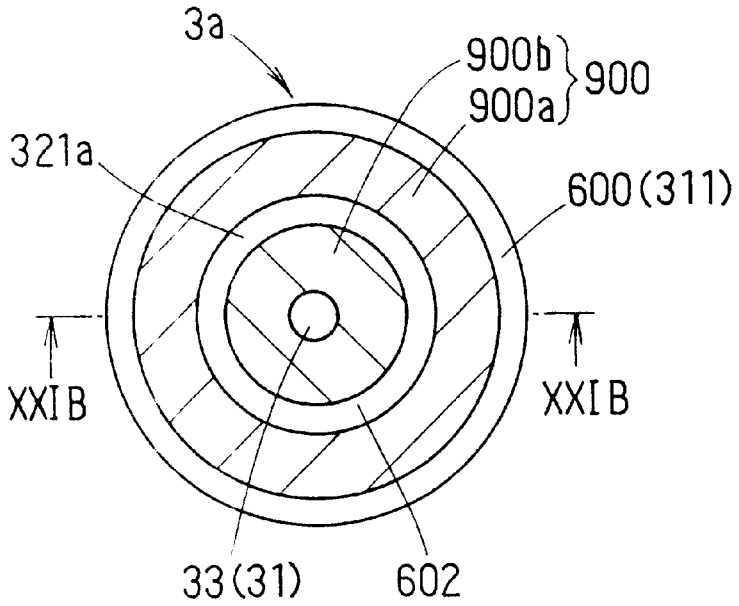
FIG. 21A is a plan view of the spark plug according to the first example of the twelfth embodiment, viewed from an arrow XXIA.
Figure 21B:
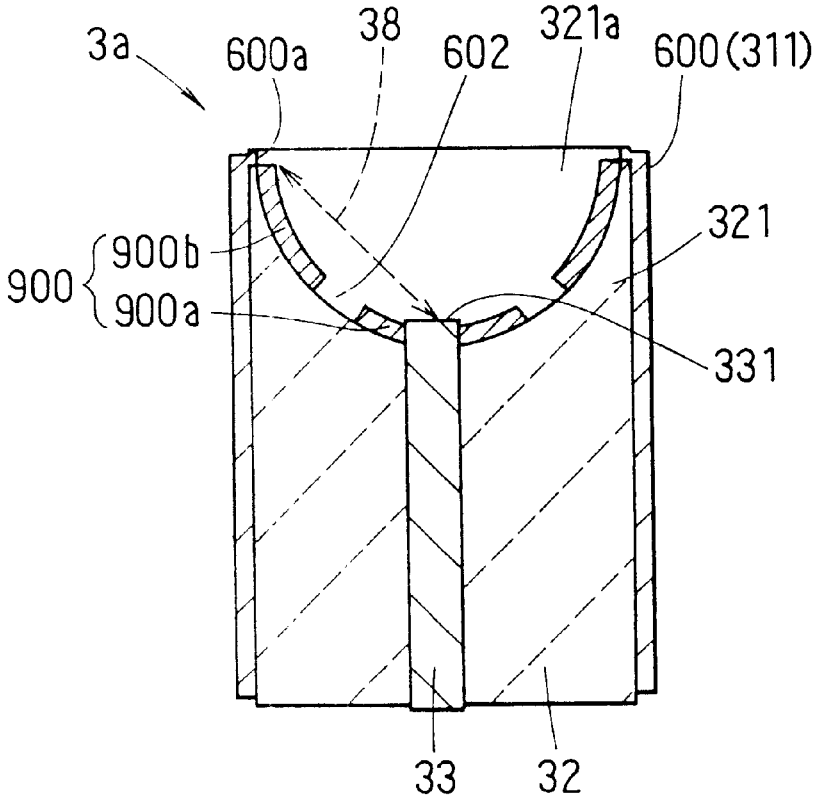
FIG. 21B is a partially sectional view taken along a line XXIB—XXIB of FIG. 21A.

FIG. 20 is an explanatory view of a total outlook of this spark plug 3 as a first example of the embodiment and in FIGS. 21A and 21B, FIG. 21A is a view viewing FIG. 20 from an arrow mark XXIA direction and FIG. 21B is a sectional view taken from a line XXIB—XXIB of FIG. 21A. In the ignition unit 3*a*, a front end face of the one end portion 321 of the insulator (porcelain insulator) 32, is formed with a cavity portion 321*a* in a semispherical shape having a radius of, for example, 2 through 5 mm and the one end portion 331 of the center electrode 33 is installed to expose at a center of a bottom portion of the cavity portion 321*a*.

According to this example, the one end portion 311 on the side of the ignition unit 3*a* of the attachment metal piece 31 in a cylindrical shape is formed as the ground electrode 600 and the ground electrode 600 is arranged in a circumferential shape at the outer periphery of the cavity portion 321*a* centering on the center electrode 33. In this case, the spark gap 38 is formed between an end portion 600*a* of the ground electrode 600 and the one end portion 331 of the center electrode 33 as shown by two arrow marks in a broken line in FIG. 21B.

Further, a bypass electrode 900 is formed by a semiconductor material or a conductive material and is provided on the surface of the cavity portion 321*a* bypassing the spark gap 38 between the center electrode 33 and the ground electrode 600. The bypass electrode 900 (hatched portion in FIG. 21A) is arranged in a circumferential shape in correspondence with the ground electrode 600 and is divided in two of a bypass electrode 900*a* on the side of the center electrode and a bypass electrode 900*b* on the side of the ground electrode 600 at a middle portion between the center electrode 33 and the ground electrode 600.

Further, a bypass gap 602 having a circumferential shape is formed centering on the center electrode 33 between the two divided bypass electrodes 900*a* and 900*b* in correspondence with the ground electrode 600 and the gap distance is, for example, 0.5 mm through 1.5 mm. Further, an end portion of the bypass electrode 900*a* on the side of the center electrode and an end portion of the bypass electrode 900*b* on the side of the ground electrode are respectively and electrically connected to the one end portion 331 of the center electrode 33 and the end portion 600*a* of the ground electrode 600.

Further, the shape of the cavity portion 321*a* of the insulator 32 is not limited to a semispherical shape so far as it is a solid of revolution with the center electrode 33 as an axis. Further, oxides of, for example, transition metals of copper, iron, cobalt, chromium, zinc and so on can be used for the semiconductor material of the bypass electrode 900 and a mixture thereof with 0 through 40% of an alkaline metal, or an alkaline earth metal of lithium, calcium, lanthanum or the like may be used for adjusting this resistivity.

An explanation will be given of the operation of the embodiment based on the first example.

When voltage is applied on the spark plug 3, the capacitive discharge (breakdown) is caused at the bypass gap 602 via the center electrode 33 and the bypass electrode 900 and thereafter, inductive discharge is caused between the two bypass electrodes 900*a* and 900*b* and between the center electrode 33 and the ground electrode 600. Therefore, also in this embodiment, a spark plug promoting ignition performance while lowering breakdown voltage can be provided.

Meanwhile, when current flows in the bypass electrode 900, the bypass electrode 900 is deteriorated by electrical or thermal energy. When deterioration in the bypass electrode 900 is progressed, particularly in the case of a semiconductor material, the resistance is increased and the electricity becomes difficult to flow. Also in such a case, the ground electrode 600 and the bypass electrode 900 are arranged in circular forms and accordingly, discharge is caused in a different path connecting the center electrode 33 and the ground electrode 600.

Further, when the bypass electrode 900 is deteriorated at the path, a different path is newly produced. In this way, paths for causing capacitive discharge are successively formed.

In this way, according to this embodiment, the ground electrode 600 and the bypass electrode 900 are arranged in circumferential shapes centering on the center electrode 33 and accordingly, even when portions of the ground and the bypass electrodes 600 and 900 are deteriorated by influence of heat or current in capacitive and inductive discharge, next discharge path is produced and the life of the spark plug 3 can be prolonged.

Figure 22A:
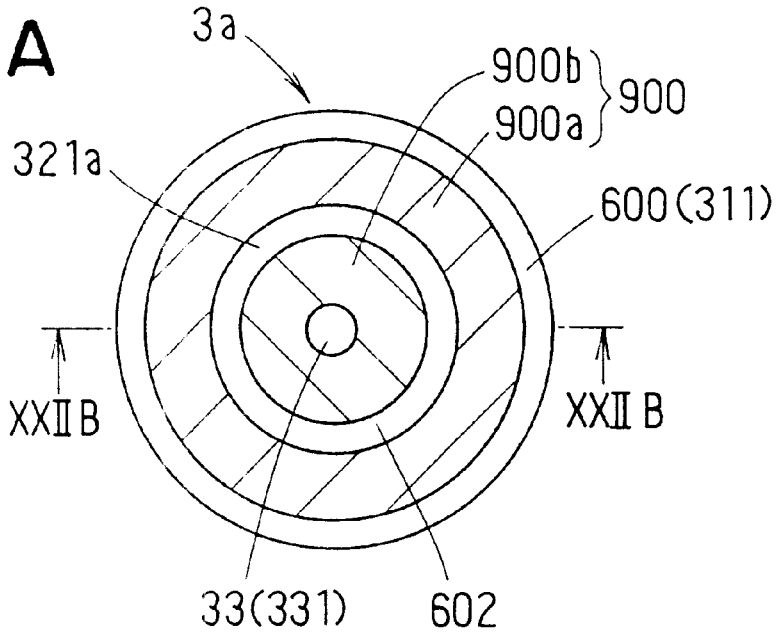
FIG. 22A is a plan view of the spark plug according to a second example of the twelfth embodiment.
Figure 22B:
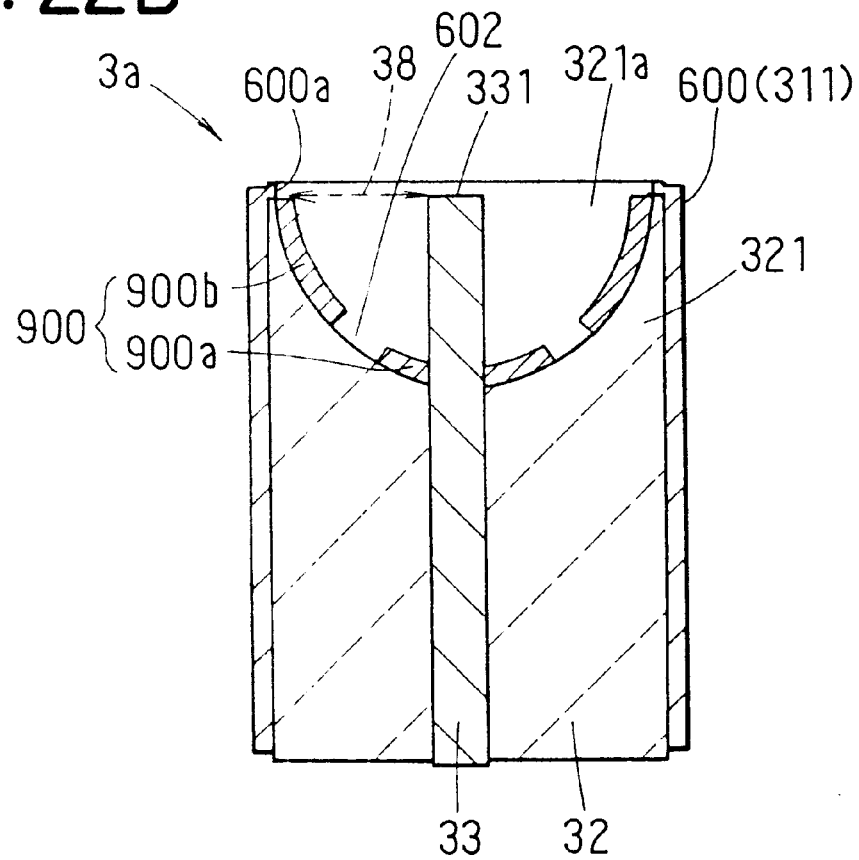
FIG. 22B is a partially sectional view taken along a line XXIIB—XXIIB of FIG. 21A.

Further, as shown by a second example indicated by FIG. 22B, the center electrode 33 may be projected from the bottom portion of the cavity portion 321*a* of the insulator 32 in a direction further approaching the end portion 600*a* of the ground 600 than in the case of FIG. 21B. The projected distance can be made, for example, about 2 through 7 mm. Thereby, compared with the first example, a range of causing discharge is widened and the ignition performance is promoted by an amount of projection of the center electrode 33 in comparison with the first example.

Figure 23:
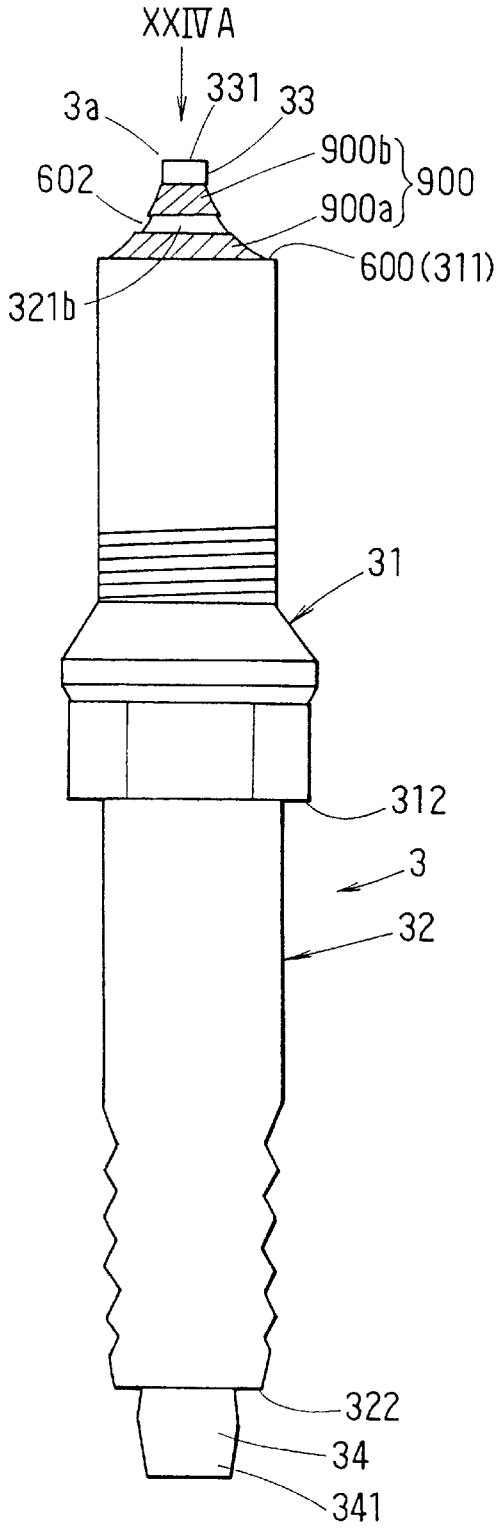
FIG. 23 is a front view of a spark plug according to a third example of the twelfth embodiment of the present invention.
Figure 24A:
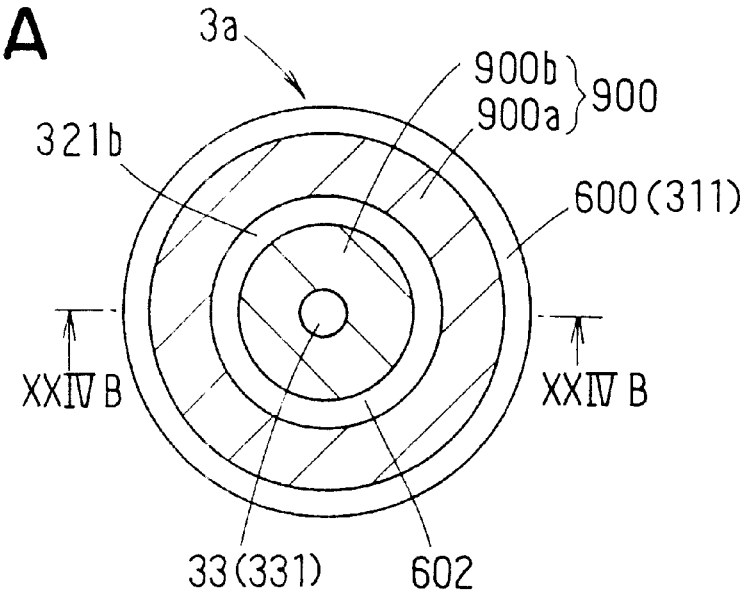
FIG. 24A is a plan view of the spark plug according to the third example of the twelfth embodiment, viewed from an arrow XXIVA.
Figure 24B:
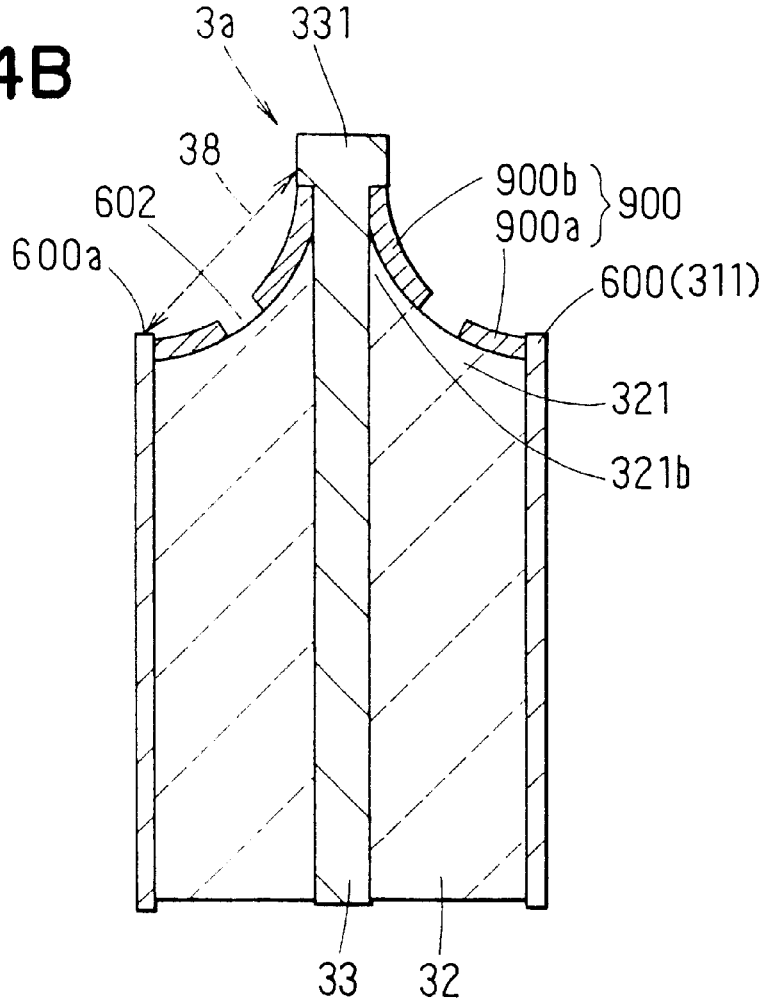
FIG. 24B is a partially sectional view taken along a line XXIVB—XXIVB of FIG. 24A.

Further, FIG. 23 is an explanatory view of a total outlook of the spark plug 3 according to a third example of this embodiment and in FIGS. 24A and 24B, FIG. 24A is a drawing viewing FIG. 23 in an arrow mark XXIVA direction and FIG. 24B is a sectional view taken along a line XXIVB—XXIVB of FIG. 24A. In the ignition unit 3*a*, a projected portion 321*b* in a conical shape having a radius of, for example, 2 through 5 mm is formed on a front end face of the one end portion 321 of the insulator 32 and the one end portion 331 of the center electrode 33 is installed to expose at the center of the projected portion 321*b*.

While in the first and the second examples, the cavity portion 321*a* is formed at the front end face of the one end portion 321 of the insulator 32, according to the third example, the projected portion 321*b* is formed which is a point of difference. In this case, the bypass electrode 900 divided in two, is mounted on a circumferential shape on the surface of the projected portion 321*b* bypassing the spark gap 38 similar to the first and the second examples and the bypass gap 602 is formed similarly in the circumferential shape.

Incidentally, the shape of the projected portion 321*b* is not limited to a conical shape so far as it is a solid of revolution with the center electrode 33 as an axis.

Meanwhile, according to the first and the second example, the position of discharge is disposed in the cavity portion 321*a* and accordingly, ignition is not caused unless fuel enters the inside of the cavity portion 321. In contrast thereto, according to the third example, the position of discharge is projected at the front end of the plug and accordingly, the ignition performance can further be promoted.

(Thirteenth Embodiment)

Specific constitutions of spark plugs according to this embodiment are shown by FIGS. 25A, 25B, 25C, 26A, 26B, 27A, 27B and 27C. In this case, FIGS. 25A and 25B indicate a first example, FIG. 26A indicates a second example, FIG. 26B indicates a third example and FIGS. 27A, 27B and 27C indicate a fourth example. According to this embodiment, the ignition unit of the spark plug shown by FIGS. 12A, 12B and 12C is modified. Further, in FIGS. 25A, 25B, 25C, 26A, 26B, 27A, 27B and 27C, portions the same as those in FIGS. 12A, 12B and 12C are attached with the same notations and further, although the noble metal chips 151A and 152A are dispensed with, they may be provided.

That is, according to this embodiment, in the face 320*a* of the insulator 32 on the side of the spark gap 38, a portion in correspondence with the bypass gap 160 formed between the divided bypass electrodes 151 and 152, is formed with a recess portion 610 comprising a groove or a cavity which is opened to the side of the bypass gap 160 and recessed in a direction separating from the bypass gap 160, which is a point of difference from the constitution of FIGS. 12A, 12B and 12C.

Figure 25A:
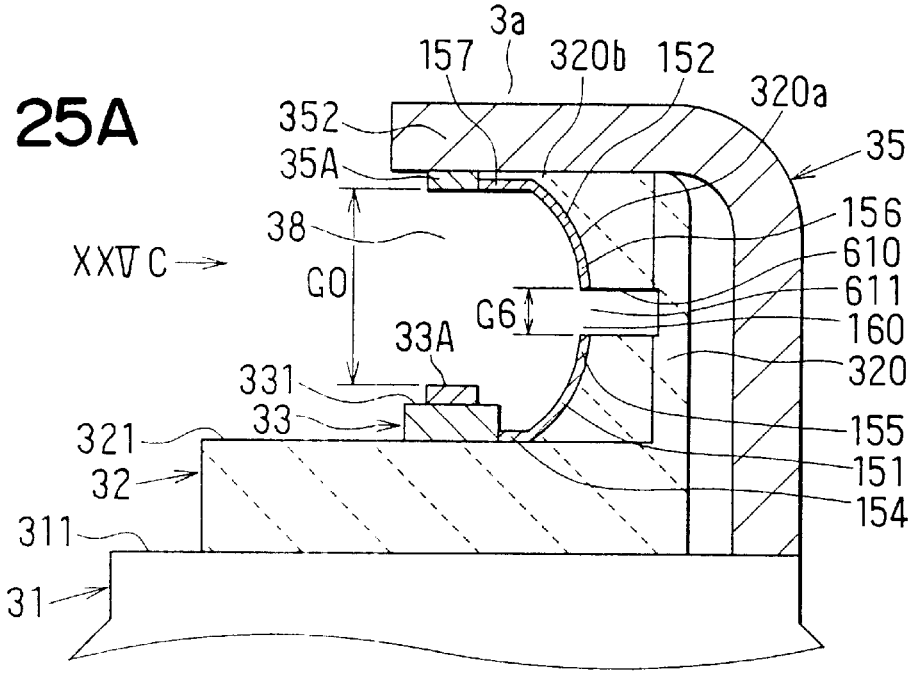
FIG. 25A is a sectional view of an ignition portion of a spark plug according to a first example of a thirteenth embodiment of the present invention.
Figure 25B:
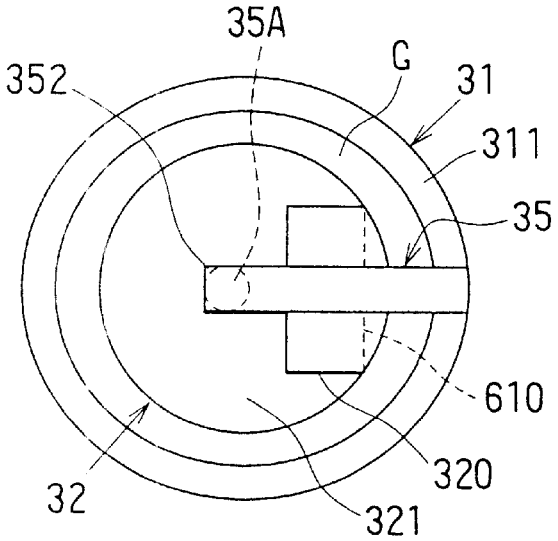
FIG. 25B is a plan view of the ignition portion of the spark plug according to the first example of the thirteenth embodiment of the present invention.
Figure 25C:
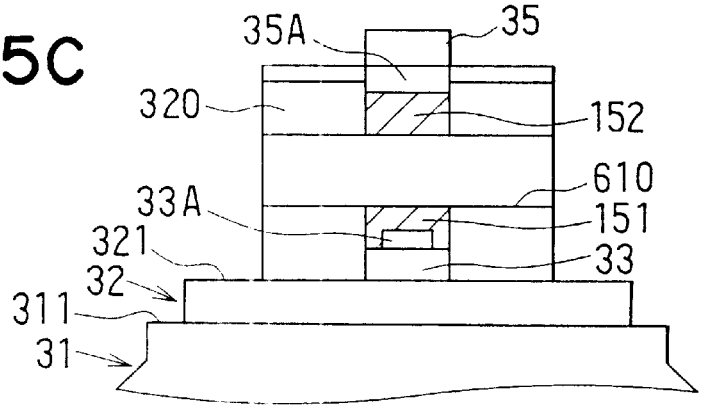
FIG. 25C is a front view of the ignition portion of the spark plug according to the first example of the thirteenth embodiment, viewed from an arrow XXVC.

FIGS. 25A, 25B and 25C show the first example of this embodiment. In FIGS. 25A, 25B and 25C, FIG. 25A is a sectional view of a ignition unit of a spark plug, FIG. 25B is a top view of FIG. 25A and FIG. 25C is a drawing viewing FIG. 25A in an arrow mark XXVC direction. In this case, although hatching is given to the bypass electrodes 151 and 152 viewing FIG. 25C and in FIG. 27C, mentioned later, for convenience of explanation, the hatching does not indicate the section but the outlook.

As shown by FIGS. 25A, 25B and 25C, the first and the second bypass electrodes 151 and 152 are installed in the face 320*a* of the projected portion 320 of the insulator 32 interposed between the center electrode 33 and the ground electrode 35 which is opposed to the spark gap 38 and the bypass gap 160 is formed between the end portions 155 and 156 of the two bypass electrodes 151 and 152. According to this embodiment, the two bypass electrodes 151 and 152 can be formed by a conductive material or a semiconductor material similar to the above-described.

Further, the face 320*a* of the projected portion 320 of the insulator 32, is formed with the recess portion 610 comprising a groove which is opened to the side of the bypass gap 160 and is recessed in a direction separating from the bypass gap 160 at a portion thereof in correspondence with the bypass gap 160. At the opening portion 611 of the recess portion 610, a distance in the up and down direction of FIG. 25A coincides with the gap distance G6 of the bypass gap 160.

Further, a distance of a path on the surface of the recess portion 610, that is, on inner wall faces formed by side faces and a bottom face which is a shortest path connecting the end portions 155 and 156 of the two bypass electrodes 151 and 152 (hereinafter, referred to as recess portion distance), is equal to about 3 times as large as the gap distance G6 of the bypass gap 160. Here, it is preferable that the recess portion distance is 1.5 through 10 times as large as the gap distance G6.

A description will be given of the operation of this embodiment based on the first example. When high voltage is applied between the ground electrode 35 and the center electrode 33, electric resistance of a path passing through the inner portions of the bypass electrodes 151 and 152 and air in the bypass gap 160 (bypass path) is smaller than electric resistance of air in the spark gap 38 and accordingly, capacitive discharge (breakdown) is caused in the bypass path. The bypass gap 160 is formed by air and accordingly, spark sufficient for ignition the mixture can be caused in the space.

Meanwhile, for example, in the case of the spark plug shown by FIGS. 12A, 12B and 12C, a distance connecting the respective end portions 155 and 156 of the bypass electrodes 151 and 152 on the face 320*a* of the insulator 32 facing the bypass gap 160 in a shortest distance is 1.0 through 1.5 times as much as the gap distance G6 and the bypass gap 160 is extremely proximate to the face 320*a* of the insulator 32.

In this case, when fuel particles, oil, carbon or the like are adhered to the face 320*a* of the insulator 32, the electric resistance of the face 320*a* of the insulator 32 is significantly reduced, the inner portions of the bypass electrodes 151 and 152 as well as adhered carbon or adhered fuel are electrically communicated with each other and breaking down (that is, smoldering) is caused without generating sufficient spark in the space.

In contrast thereto, according to this embodiment, by forming the recess portion 610, the above-described recess portion distance facing the bypass gap 160 is prolonged to about 3 times as large as the gap distance G6 and the bypass gap 160 and the surface of the insulator 32 are separated from each other. Accordingly, smoldering caused by adhering carbon, fuel or oil on the surface of the insulator 32 (surface of recess portion 610) can be avoided.

Particularly before increasing an injection combustion pressure in starting an engine, spray where atomization is insufficient is included in the mixture and accordingly, fuel, oil or the like is liable to adhere and at a low temperature, evaporation of fuel is retarded and accordingly, fuel, oil or the like is similarly liable to adhere, however, according to the embodiment, excellent ignition performance can be ensured even in starting an engine or when the engine is at a low temperature.

Figure 26A:
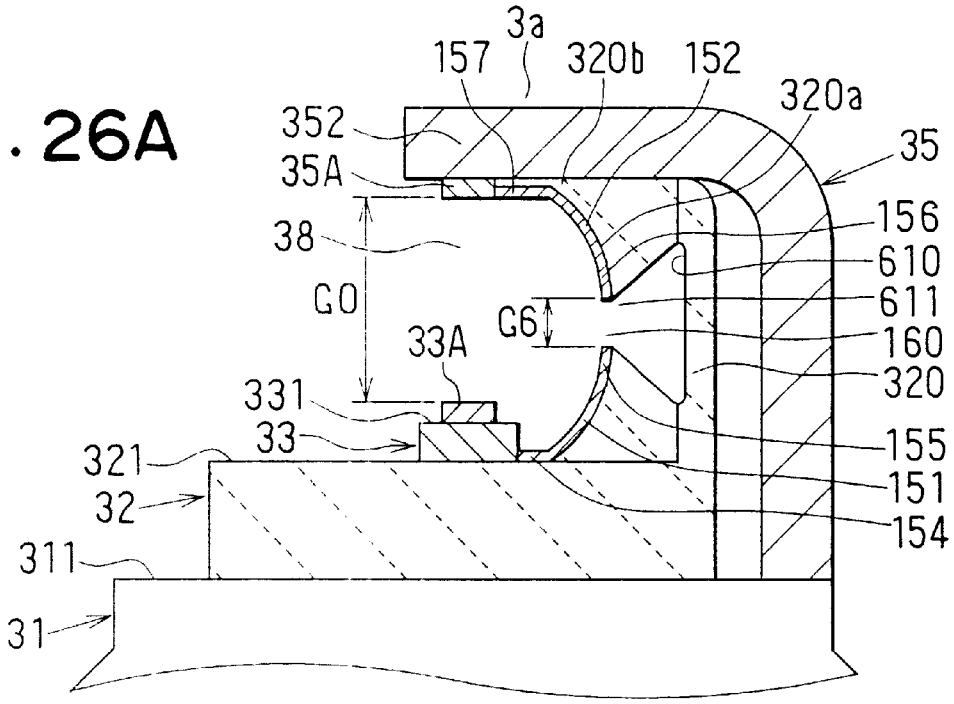
FIG. 26A is a sectional view of an ignition portion of a spark plug according to a second example of the thirteenth embodiment.
Figure 26B:
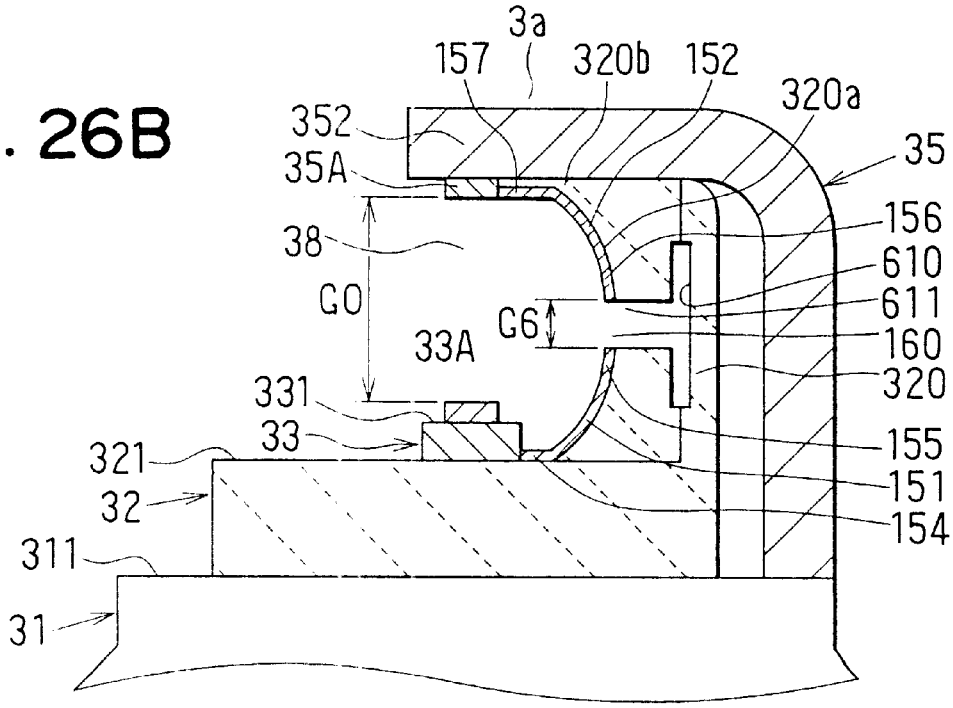
FIG. 26B is a sectional view of an ignition portion of a spark plug according to a third example of the thirteenth embodiment.

Further, even in the case where the recess portion 610 is formed in a groove shape diverging from the side of the opening portion 611 toward the side of the bottom portion and the distance of the recess portion is enlarged as in the second and the third example shown by FIGS. 26A and 26B, operation and effect similar to those in FIGS. 25A, 25B and 25C can be provided.

Figure 27A:
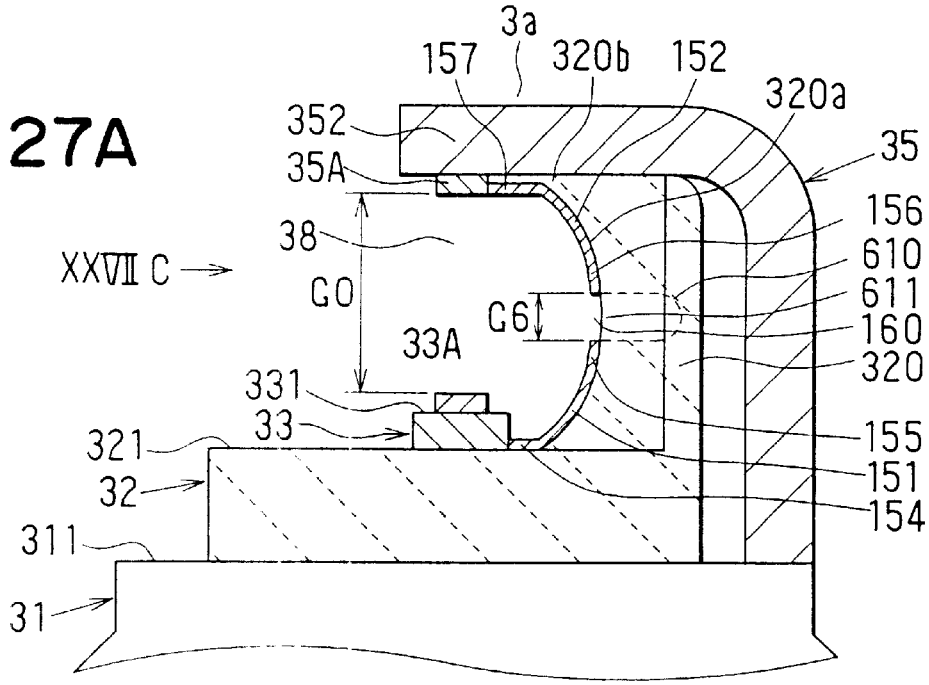
FIG. 27A is a sectional view of an ignition portion of a spark plug according to a fourth example of the thirteenth embodiment of the present invention.
Figure 27B:
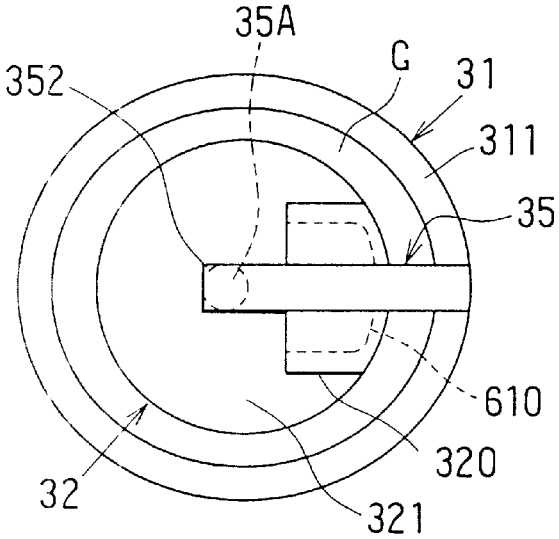
FIG. 27B is a plan view of the ignition portion of the spark plug according to the fourth example of the thirteenth embodiment of the present invention.
Figure 27C:
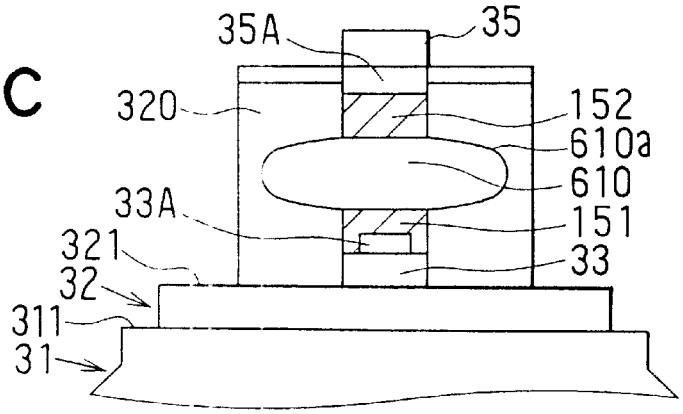
FIG. 27C is a front view of the ignition portion of the spark plug according to the fourth example of the thirteenth embodiment, viewed from an arrow XXVIIC.

Further, FIGS. 27A, 27B and 27C show a fourth example of this embodiment and a difference from the first through the third examples mentioned above, resides in that although the recess portion 610 is formed by the groove according to the first through the third examples, according to the fourth example, the recess portion 610 is formed by a cavity. Also in the fourth example, the above-described recess portion distance is several times as large as the gap distance G6 of the bypass gap and further, the distance connecting the respective end portions 155 and 156 of the bypass electrodes 151 and 152 is several times as large as the gap distance G6 at the edge portion of the recess in the recess portion 610.

Further, also in the fourth example, the operation and effect of the above-described embodiment can be achieved. Further, according to the fourth example, as shown by FIG. 27C, the shape of the recess, that is, the edge portion of the recess is formed in an elliptical curved face, a similar effect can be achieved even with a spherical face or a polygonal face.

As mentioned above, a description has been given of this embodiment based on the first through the fourth examples, this embodiment is characterized in that a recess is formed at a portion of the surface of the insulator in correspondence with the bypass gap as mentioned above and the constitution may naturally be combined with the fourth through the seventh embodiments as well as the other modified example of the ninth embodiment and so on.

(Fourteenth Embodiment)

This embodiment is mainly characterized in that in the above-described respective embodiments except the twelfth embodiment formed by the bypass electrode in a circumferential shape, a bypass electrode is formed in a shape meandering in respect of a central axis T1 connecting the center electrode 33 and the ground electrode 35. FIGS. 28A, 28B and 28C and FIGS. 29A, 29B and 29C show respective examples of this embodiment. In this case, according to this respective examples of the embodiment, a description will be given as examples of modifying the bypass electrode in the spark plug (ninth embodiment) shown by FIGS. 12A, 12B and 12C.

Accordingly, a description will mainly be given of the constitution of the bypass electrode different from that in FIGS. 12A, 12B and 12C and in the drawings, the same portions are attached with the same notations and an explanation thereof will be omitted.

Figure 28A:
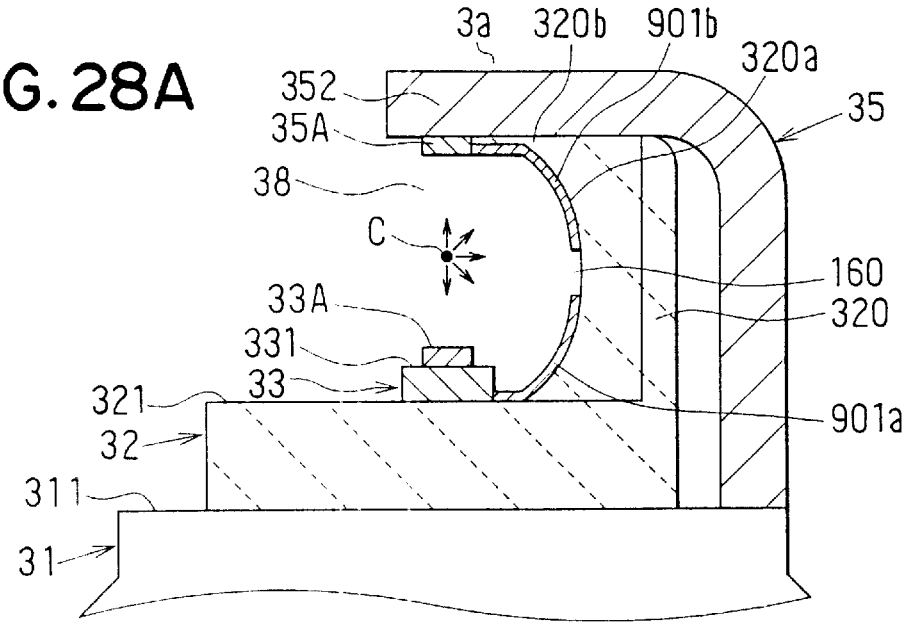
FIG. 28A is a sectional view of an ignition portion of a spark plug according to a first example of a fourteenth embodiment of the present invention.
Figure 28B:
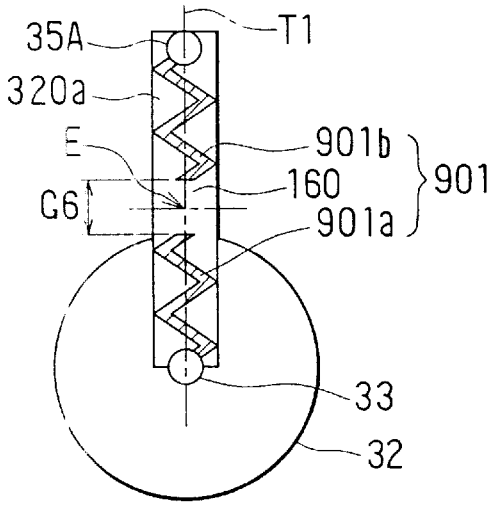
FIG. 28B is a part of an enlarged view of an electrode in FIG. 28A according to a first example of a fourteenth embodiment.
Figure 28C:
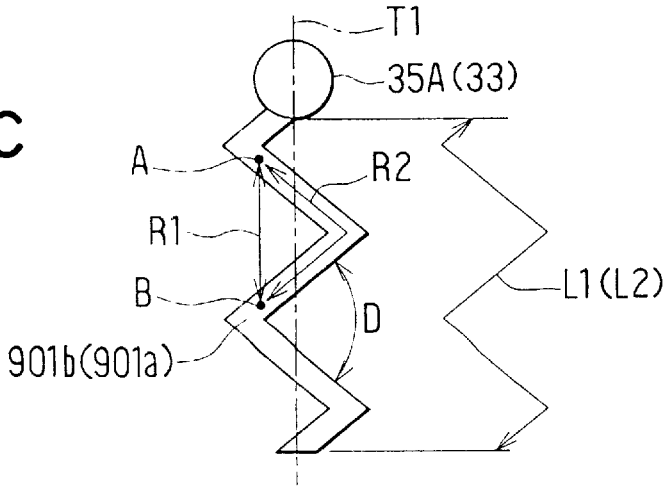
FIG. 28C is a part of an enlarged view of a meandering shape in FIG. 28B according to the first example of the fourteenth embodiment.

FIGS. 28A, 28B and 28C show a first example of this embodiment in which FIG. 28A is a sectional view of the ignition unit 3*a* of a spark plug, FIG. 28B is an enlarged view viewing the electrode constitution in FIG. 28A in a direction orthogonal to the face 320*a* of the projected portion 320 of the insulator 32 facing the spark gap 38 (point C in FIG. 28A) and FIG. 28C is an enlarged view of a meandering shape in FIG. 28B.

Figure 29A:
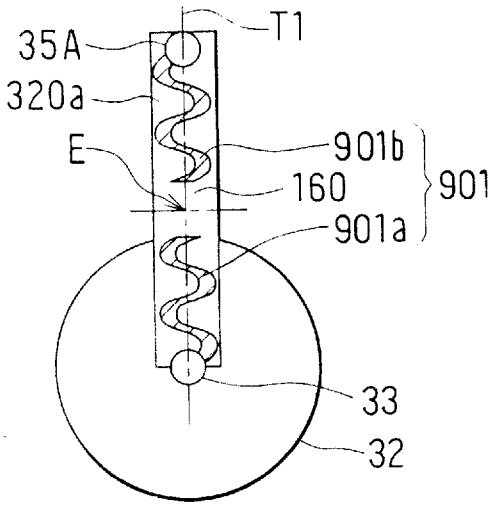
FIG. 29A is a part of an enlarged view of an electrode according to a second example of the fourteenth embodiment.
Figure 29C:
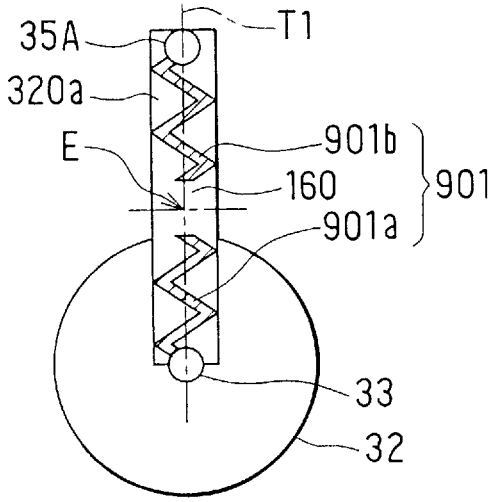
FIG. 29C is a part of an enlarged view of an electrode according to a fourth example of the fourteenth embodiment.
Figure 29B:
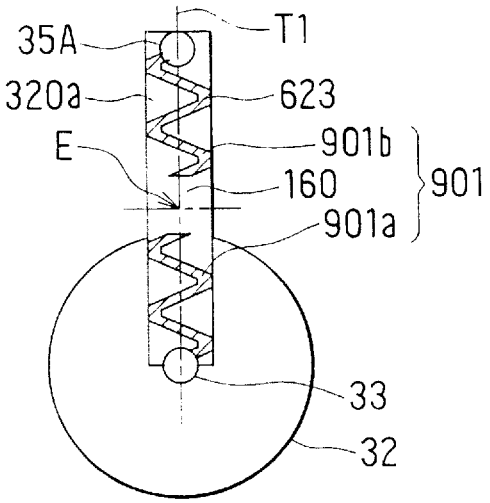
FIG. 29B is a part of an enlarged view of an electrode according to a third example of the fourteenth embodiment.
Figure 30:
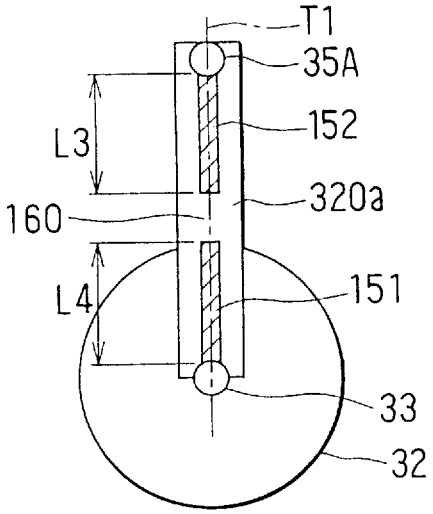
FIG. 30 is a part of an enlarged view of an electrode according to the ninth embodiment to compare with the fourteenth embodiment.

Further, FIGS. 29A, 29B and 29C show a second through a fourth example of this embodiment in which FIG. 29A shows a second example, FIG. 29B shows a third example and FIG. 29C shows a fourth example which are viewed from the directions the same as the direction of FIG. 28B. Further, FIG. 30 is an explanatory view for comparing with this embodiment in correspondence with a drawing viewing the spark plug in FIGS. 12A, 12B and 12C in a direction the same as the direction of FIG. 28B. Further, in FIG. 28B, FIGS. 29A, 29B and 29C and FIG. 30, the noble metal chips 33A, 151A and 152A are omitted and the bypass electrode 901 is shown by hatching for convenience of explanation.

As shown by FIG. 30, according to the spark plug of FIGS. 12A, 12B and 12C, the two bypass electrodes 151 and 152 are installed along a central axis connecting the center electrode 33 and the noble metal chip 35A of the ground electrode 35, that is, the central axis T1 connecting the spark gap 38. Accordingly, in FIG. 30, the bypass electrodes 151 and 152 are formed in a linear shape along the central axis T1.

Meanwhile, as shown by FIGS. 28B and 28C, according to the first example, the bypass electrode 901 is formed by a first bypass electrode 901*a* conducting to the center electrode 33 and a second bypass electrode 901*b* conducting to the noble metal chip 35A of the ground electrode 35 and the bypass gap 160 is formed between the two bypass electrodes 901*a* and 901*b* similar to FIGS. 12A, 12B and 12C. Further, it is preferable that the gap distance G6 of the bypass gap 160 is 1.0 mm or less according to the embodiment.

However, according to the first example, as shown by FIGS. 28B and 28C, the two bypass electrodes 901*a* and 901*b* are flexed by a predetermined angle D and are formed in a meandering shape crossing the central axis T1 for several times in the left and right directions of the drawing. Thereby, distances of L1 and L2 of the bypass electrode from the center electrode 33 and the noble metal chip 35A of the ground electrode 35 to the bypass gap 160, can be increased by several times (for example, 1.1 through 3.0 times) as large as distances L3 and L4 of the bypass electrodes shown by FIG. 30 by setting the angle D.

Incidentally, notations out of parentheses in FIG. 28C relate to the second bypass electrode 901*b* and notations in parentheses relate to the first bypass electrode 901*a*.

Further, as shown by FIG. 28C, in respect of the two bypass electrodes 901*a* and 901b, electric resistance R2 of the bypass electrode 901*a* or 901*b* of a path along the bypass electrode 901*a* or 901*b* between an unspecified point (for example, point A) to other unspecified point (for example, point B), is smaller than electric resistance R1 in space connecting the points A and B by a straight line. Accordingly, even in the case where the path linearly connecting the space having no electrode is shorter than the path passing through the electrode in respect of the distance between two points having the electrode such as between the points A and B, current flows in the electrode.

Next, an explanation will be given of the operation of this embodiment based on the first example.

When high voltage is applied on the two bypass electrodes 901*a* and 901*b*, capacitive discharge is caused at the bypass gap 160. In this case, in the bypass electrodes 901*a* and 901*b*, the distances where current flows, that is, the distances L1 and L2 of the bypass electrodes are longer than the distances L3 and L4 of the bypass electrodes shown by FIG. 30 and accordingly, as a result, ionization is carried out from wide areas and an absolute amount of ionization of the space is increased. Therefore, the ionization at the vicinity of spark gap 38 is expedited and the ignition performance is further promoted.

Figure 31A:
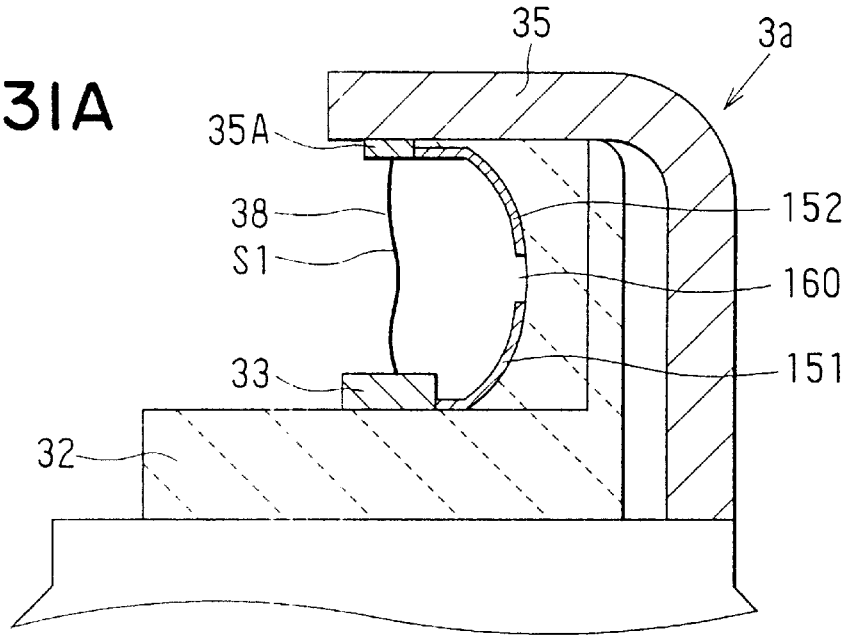
FIGS. 31A and 31B are schematic sectional views to explain discharge sparks according to the fourteenth embodiment.
Figure 31B:
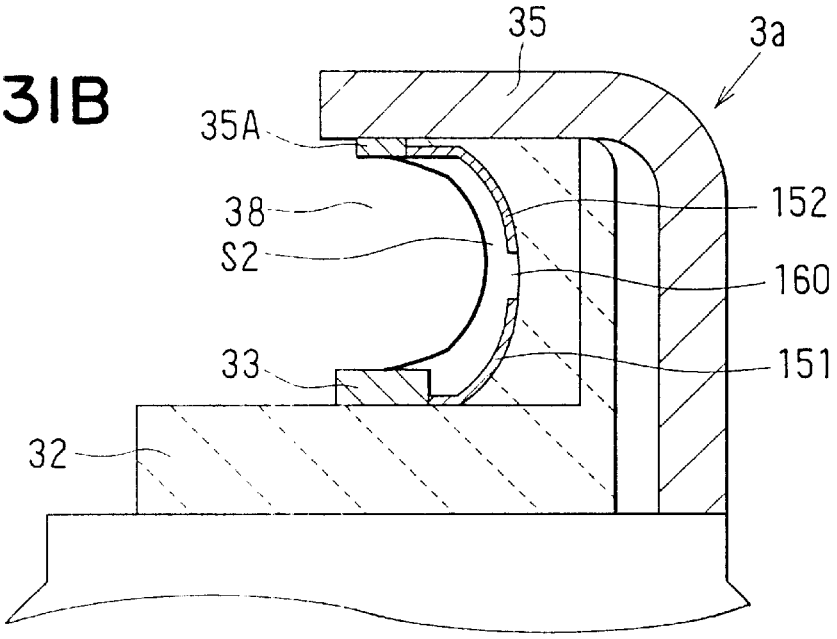

Particularly, in the case of discharging under a high pressure environment, the density of air is increased by which in the case of capacitive discharge, the width of an ionized air layer tends to reduce as the layer becomes remote from the bypass electrode (direction orthogonal to surface of bypass electrode). Accordingly, ions generated at the bypass electrodes 151 and 152 are difficult to move toward the spark gap 38. Thereby, in the case of inductive discharge, a linear spark S1 connecting the spark gap 38 (refer to FIG. 31A) is not caused but an arc-shaped spark S2 shifted along the bypass electrodes 151, 152 (refer to FIG. 31B) is caused.

In such a case of spark in a circular arc shape, the path of spark is long and the breakdown voltage in increased and accordingly, the discharge maintaining time period is shortened. However, according to the embodiment, by increasing the absolute amount of ionization, ionization at a vicinity of the spark gap 38 can be expedited and therefore, even in the case of an engine where a high compression ratio is achieved in order to improve combustion and promote output or the like, the linear spark can be realized and the discharge maintaining time period can be prevented from shortening.

The operation and effect of this embodiment mentioned above can similarly be achieved in the first through the fourth example of this embodiment shown by FIGS. 29A, 29B and 29C. According to the second example of the embodiment shown by FIG. 29A while according to the first example, the meandering line shape is formed by bending the bypass electrode 901 by a certain angle D, the respective bypass electrodes 901*a* and 901*b* are meandered in a curved shape.

According to the third example of this embodiment shown by FIG. 29B, a linear portion 623 in parallel with the central axis T1 is provided at each of the bent portions of the respective bypass electrodes 901*a* and 901*b*. Further, according to the first through the third examples, the meandering shape of the two bypass electrodes 901*a* and 901*b* is in point symmetry in respect of a center point E of the bypass gap 160, however, according to the fourth example of this embodiment shown by FIG. 29C, the shape is in line symmetry with the bypass gap 160 as an axis of symmetry.

As mentioned above, a description has been given of this embodiment based on the first through the fourth examples and this embodiment is characterized in that the bypass electrode is formed in a meandering shape in order to expedite ionization as stated above and the constitution may naturally be combined with the respective embodiments except the twelfth embodiment including a case where the bypass gap is not provided and the bypass electrode is formed by a single piece as in, for example, the first embodiment.

(Fifteenth Embodiment)

In the first embodiment or the like, for example, the projected portion 320 is formed by projecting the insulator (porcelain insulator) 32 between the center electrode 33 and the ground electrode 35 by which the path for installing the bypass electrode is formed. According to the constitution, as shown by the respective drawings referred to in the first embodiment, the projected portion 320 having a complicated shape is formed in a narrow space between the center electrode 33 and the ground electrode 35 and accordingly, time and labor is needed in machining or fabrication of mold.

This embodiment is characterized in that a cavity portion which is recessed in a direction of separating from the spark gap is formed and the bypass electrode is installed there and the path for installing the bypass electrode can simply be formed. Respective examples of the embodiment are shown by FIGS. 32, 33A, 33B, 34, 35A, 35B, 36, 37A and 37B.

Figure 32:
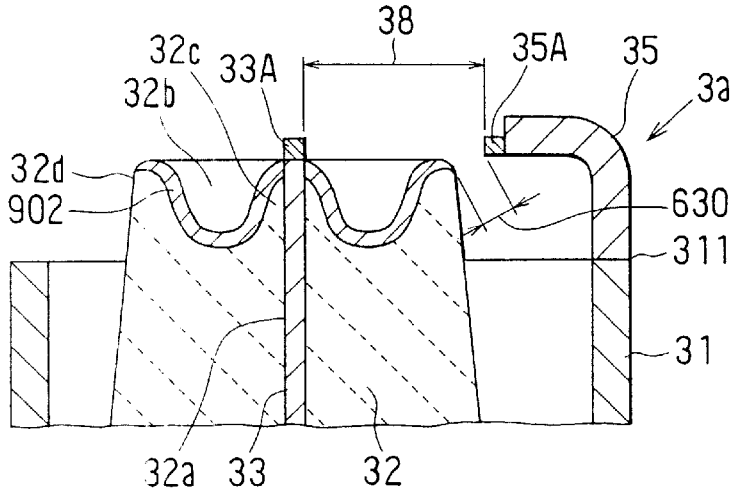
FIG. 32 is a part of a sectional view of a spark plug according to a first example of a fifteenth embodiment of the present invention.

FIG. 32 is a sectional view of the ignition unit 3*a* according to a first example of this embodiment. According to the first example, the constitution of the insulator is changed at the ignition unit 3*a* of the spark plug 3 shown by the first embodiment and arrangement, constitution and the like of the respective electrodes are changed along therewith. Further, in FIG. 32, portions the same as those in the first embodiment are attached with the same notations.

The center electrode 33 is fitted to a shaft hole 32*a* of the insulator (porcelain insulator) 32 fitted to the attachment metal piece 31 and the ground electrode 35 is installed in one end portion 311 of the attachment metal piece 31. According to the example, a cavity portion 32*b* is formed at a front end portion of the insulator 32 interposed between the center electrode 33 and the ground electrode 35 in a shape of concentric circles recessed in a direction separating from the spark gap 38.

Further, a projected portion 32*c* in a projected shape is formed at the central portion of the front end portion of the same insulator 32, the center electrode 33 is exposed at the top portion of the projected portion 32*c* and the noble metal chip 33A is mounted on the exposed portion. Further, the ground electrode 35 is extended to an outer peripheral portion 32*d* of the front end portion of the insulator 32 and the noble metal chip 35A is mounted on the front end of the ground electrode 35. Further, a spark gap (large spark gap) 38 is formed between the noble metal chip 33A of the center electrode 33 and the noble metal chip 35A mounted on the front end of the ground electrode 35.

Further, a bypass electrode (intermediate electrode) 902 comprising a semiconductor material of copper oxide or the like is formed in a film-like shape over an entire region of the surface of the cavity portion 32*b* of the insulator 32. In this case, space is formed and a bypass gap (small spark gap) 630 is formed between the bypass electrode 902 and the noble metal chip 35A of the ground electrode 35 and the bypass electrode 902 and the center electrode 33 are electrically connected.

Figure 33A:
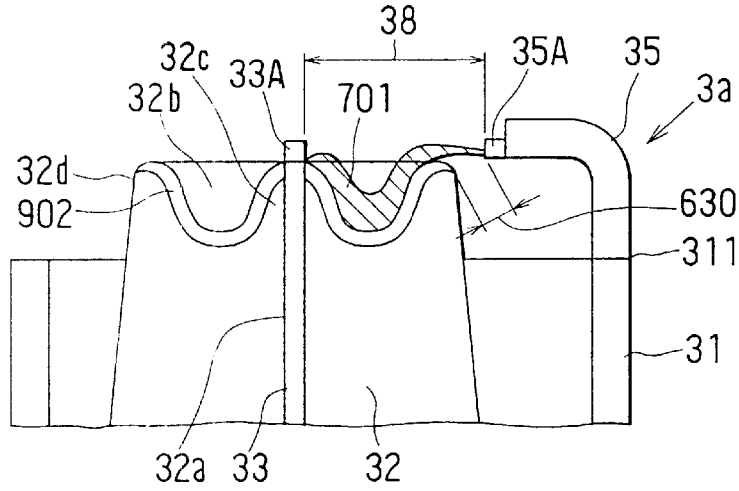
FIGS. 33A and 33B are schematic illustrations to explain its operations according to the first example of the fifteenth embodiment.
Figure 33B:
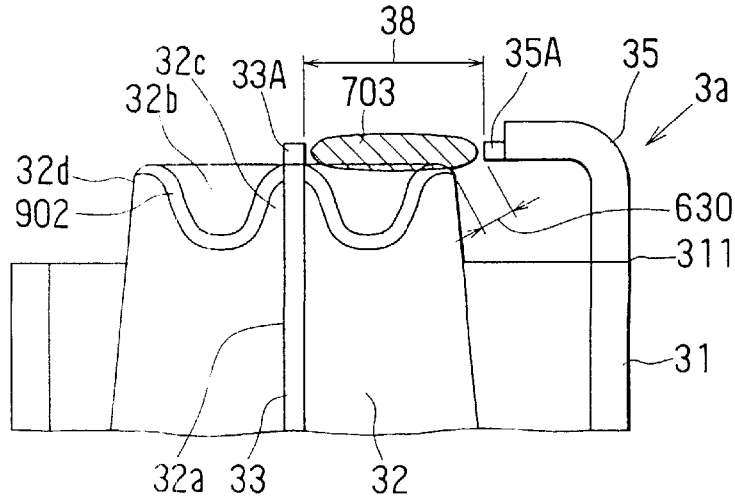

An explanation will be given of the operation of this embodiment in reference to FIGS. 33A and 33B for explaining the operation based on the first example having such a constitution. When voltage is applied on the spark plug by an ignition coil, firstly, creeping discharge is caused between the center electrode 33 and the surface of the bypass electrode 902 and capacitive discharge 701 (breakdown) is caused at the bypass gap 630. This state is shown by FIG. 33A.

Particularly, according to this example, the bypass electrode 902 is formed by a semiconductor material and therefore, free electrons are liable to generate from the surface of the semiconductor and by the effect of the creeping discharge and the effect of the semiconductor material, voltage of capacitive discharge can be made low. Then, when the capacitive discharge is once caused, a vicinity of the discharge path is ionized and accordingly, the discharge path of the inductive discharge 703 is shifted to the shortest path of the spark gap 38 (refer to FIG. 33B). This is because the electric resistance of air in the spark gap 38 constituting a spark discharge portion becomes lower than the electric resistance of the bypass electrode 902 by the ionization.

As described above, according to this embodiment, similar to the above-described respective embodiments, a spark plug promoting ignition performance while lowering breakdown voltage can be provided. Further, according to this embodiment, the cavity portion 32*b* is formed in concentric circles, the cavity portion 32*b* can simply be formed by machining or molding the insulator 32 and accordingly, a spark plug having a simple structure, easy to fabricate and having high practical performance can be provided.

Figure 34:
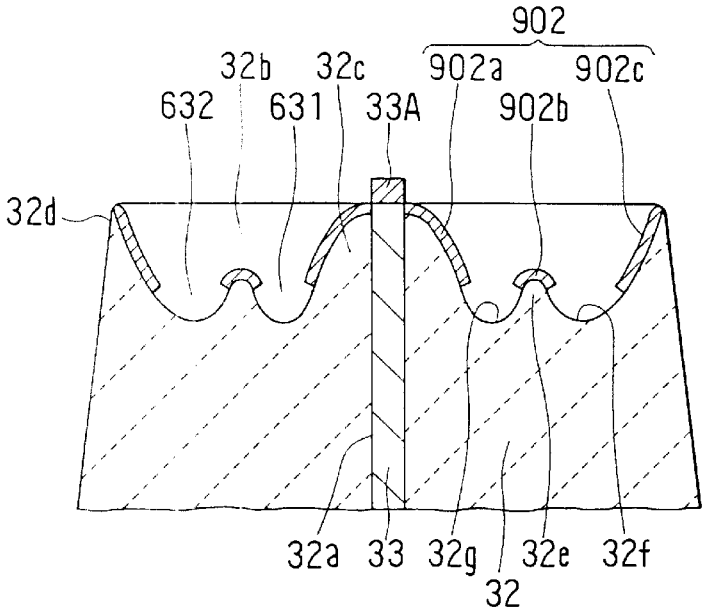
FIG. 34 is a part of a sectional view of a spark plug according to a second example of the fifteenth embodiment of the present invention.

Here, FIG. 34 shows a second example of this embodiment in which a projected portion 32*e* is formed on the surface of the bottom portion of the cavity portion 32*b* in a concentric circle shape and recess and projection is formed thereby along with recess portions 32*f* and 32*g*. Further, as shown by FIG. 34, in the cavity portion 32*b*, the bypass electrode 902 is not formed at the recess portions 32*f* and 32*g* and bypass electrodes 902*a*, 902*b* and 902*c* in shapes of concentric circles which are divided in three, are installed in the projected portion 32*e* and above the projected portion 32*e*.

Further, a bypass gap 631 between the bypass electrodes 902*a* and 902*b* is disposed in correspondence with the recess portion 32*g* on the side of the center electrode 33 and a bypass gap 632 between the bypass electrodes 902*b* and 902*c* is disposed in correspondence with the recess portion 32*f* on the side of the ground electrode 35. Thereby, in capacitive discharge, initial spark discharge is caused at the bottom portion of the cavity portion 32*b*, ionization is caused and accordingly, spark is liable to move gradually to the side of the spark gap 38. As mentioned above, according to the second example, a means capable of providing a number of the bypass gaps can be proposed.

Figure 35A:
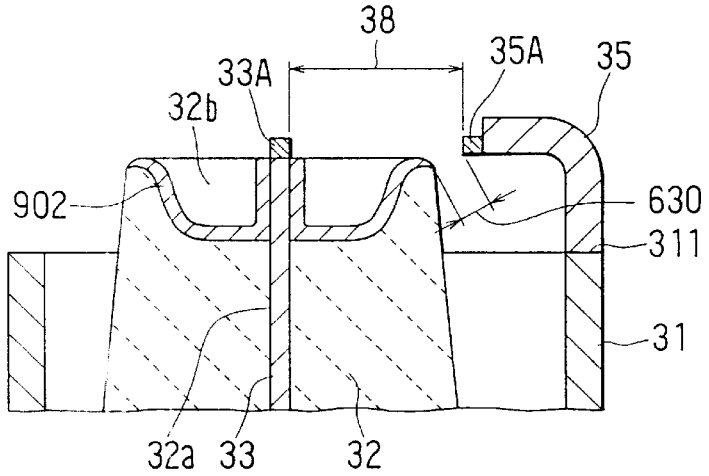
FIG. 35A is a part of a sectional view of a spark plug according to a third example of the fifteenth embodiment of the present invention.

FIG. 35A shows a third example of this embodiment in which in the first example shown by FIG. 32, the projected portion 32*c* of the insulator 32 is dispensed with and in place thereof, the bypass electrode 902 is formed on the side face of the exposed center electrode 33. The example can also achieve operation and effect similar to that in the first example.

Figure 35B:
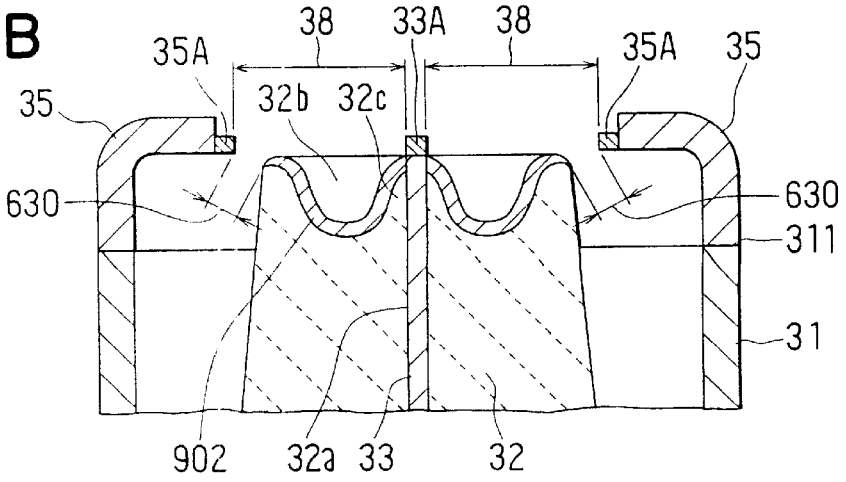
FIG. 35B is a part of a sectional view of a spark plug according to a fourth example of the fifteenth embodiment of the present invention.

FIG. 35B shows the fourth example of this embodiment in which in the first example shown by FIG. 32, a plurality, for example, 2 or 3 (2 in the drawing) of the ground electrodes 35 are prepared and in addition to operation and effect of this embodiment, a plurality of discharge paths can be provided and the durability of the plug can be promoted.

Figure 36:
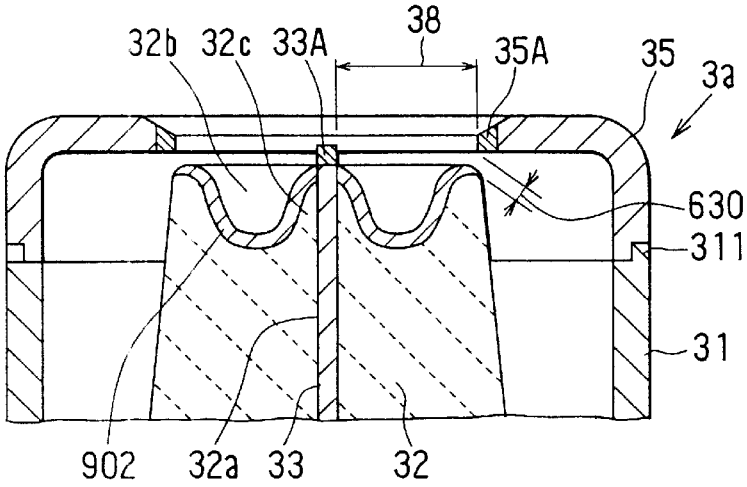
FIG. 36 is a part of a sectional view of a spark plug according to a fifth example of the fifteenth embodiment of the present invention.

Further, FIG. 36 shows a fifth example of this embodiment in which in the first example shown by FIG. 32, the ground electrode 35 is formed in a disk-like shape where the center is hollowed. In this case, an effect is achieved by combining the constitution of the ground electrode 35 with the constitution of the insulator 32 having the cavity portion 32*b* in a concentric shape.

Figure 37A:
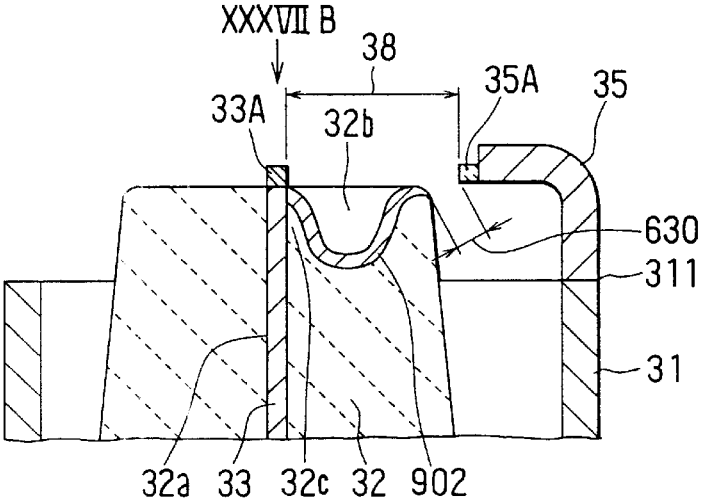
FIG. 37A is a part of a sectional view of a spark plug according to a sixth example of the fifteenth embodiment of the present invention.
Figure 37B:
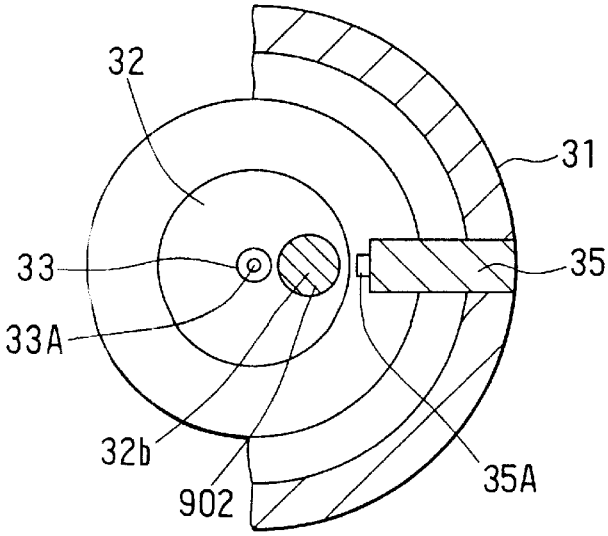
FIG. 37B is a part of an enlarged plan view according to the sixth example of the fifteenth embodiment, viewed from an arrow XXXVIIB of FIG. 37A.

Further, FIGS. 37A and 37B show the sixth example of this embodiment in which FIG. 37B is a drawing viewing FIG. 37A in an arrow mark XXXVIIB direction. According to this example, the cavity portion 32*b* is formed not in a shape of a concentric circle but in a shape where a portion of the front end of the insulator 32 is recessed by which not only the effect of the embodiment is achieved but an effect where only a small amount of material of the bypass electrode is needed.

(Other Modifications)

First, although according to the fourth through the seventh embodiments the bypass electrodes 5, 6, 7 and 8 are formed by a conductive material, they may be formed by a semiconductor material used in the first through the third embodiments. Thereby, in addition to ionization by insulation breakdown at the bypass gaps 91, 92, 93, 94 and 95, ionization is also carried out by discharging electrons from the bypass electrodes 5, 6, 7 and 8 and accordingly, inductive discharge can be carried out at the spark gap further excellently.

Further, although according to the fourth through the seventh embodiments, three or more of the bypass gaps are formed, two of the bypass gaps may be formed. That is, the bypass gap may not be formed at the bypass electrode.

Further, although according to the tenth and the eleventh embodiments, the constitution of the first embodiment shown by FIGS. 2A, 2B and 2C is used in respect of the ignition unit, the constitution may be replaced by that having the ignition units according to the second through the ninth embodiments as well as the twelfth through the fifteenth embodiments.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A spark plug comprising:

a center electrode;

a ground electrode having a spark gap between said center electrode and said ground electrode;

a bypass electrode disposed so as to extend along a bypass path between said center electrode and said ground electrode, said bypass path having a length greater than any straight line distance between opposed surfaces of said center electrode and said ground electrode, whereby said bypass path is spaced away from said spark gap and such that an inductive discharge occurs via said spark gap after a breakdown occurs via said bypass electrode when a breakdown voltage is applied between said center electrode and said ground electrode.

2. A spark plug according to claim 1, wherein:

said bypass electrode includes a semiconductor material, and is continuous, and is formed between said center electrode and said ground electrode for electrically connecting said center electrode and said ground electrode.

3. A spark plug according to claim 2, wherein:

an electric resistance of said semiconductor material is within a range between 1 Ω·cm and $10^4$ Ω·cm.

4. A spark plug according to claim 3, wherein:

a distance of said spark gap is within a range between 0.75 mm and 10.0 mm.

5. A spark plug according to claim 1, wherein:

said bypass electrode includes a semiconductor material, and forms a first bypass gap between said center electrode and said bypass electrode, and forms a second bypass gap between said ground electrode and said bypass electrode.

6. A spark plug according to claim 5, wherein:

said bypass electrode is divided into at least two; and said divided bypass electrodes has a third bypass gap therebetween.

7. A spark plug according to claim 6, wherein:

said ground electrode is disposed along said bypass electrode to form a condenser between said bypass electrode and said ground electrode.

8. A spark plug according to claim 7, wherein:

said bypass electrode includes a condenser formed at any one of said bypass gaps; and a capacitance of said condenser formed between said bypass electrode and said ground electrode is greater than or equal to five times as a capacitance of said condenser formed at any one of said bypass gaps.

9. A spark plug according to claim 8, wherein:

the spark plug has an insulator between said ground electrode and said bypass electrode.

10. A spark plug according to claim 5, wherein:

a distance of each one of said bypass gaps is shorter than a distance of said spark gap; and a total distance of all of said bypass gaps is longer than said distance of said spark gap.

11. A spark plug according to claim 10, wherein:

said distance of each one of said bypass gaps is within a range between 0.5 mm and 1.5 mm.

12. A spark plug according to claim 5, wherein:

a noble metal chip is integrally mounted on a portion, which is opposed to said bypass gap, of said center electrode, said ground electrode and said bypass electrode.

13. A spark plug according to claim 5, wherein:

an electric resistance of said semiconductor material is within a range between 1 Ω·cm and $10^4$ Ω·cm.

14. A spark plug according to claim 5, wherein:

a distance of said spark gap is within a range between 0.75 mm and 10.0 mm.

15. A spark plug according to claim 1, wherein:

said bypass electrode includes a semiconductor material, and is divided into a first bypass electrode and a second bypass electrode;

said first bypass electrode is electrically connected to said center electrode;

said second bypass electrode is electrically connected to said ground electrode; and a bypass gap is formed between said first bypass electrode and said second bypass electrode.

16. A spark plug according to claim 15, wherein:

a distance of said bypass gap is shorter than a distance of said spark gap.

17. A spark plug according to claim 16, wherein:

said distance of said bypass gap is within a range between 0.5 mm and 3.0 mm.

18. A spark plug according to claim 17, wherein:

said distance of said spark gap is within a range between 0.75 mm and 10.0 mm.

19. A spark plug according to claim 15, wherein:

a noble metal chip is integrally mounted on a portion, which is opposed to said bypass gap, of said center electrode, said ground electrode and said bypass electrode.

20. A spark plug according to claim 15, wherein:

an electric resistance of said semiconductor material is within a range between 1 Ω·cm and $10^4$ Ω·cm.

21. A spark plug according to claim 1, wherein:

said ground electrode has a ring shape locating said center electrode on a center of said ring-shaped ground electrode; and said bypass electrode has a ring shape, and is located between said center electrode and said ground electrode.

22. A spark plug according to claim 21, wherein:

said bypass electrode is divided into at least two in its circumferential direction; and said divided bypass electrodes has a ring-shaped bypass gap therebetween.

23. A spark plug according to claim 22, wherein:

a distance of said ring-shaped bypass gap is within a range between 0.5 mm and 1.5 mm.

24. A spark plug according to claim 23, wherein:

said distance of said spark gap is within a range between 0.75 mm and 10.0 mm.

25. A spark plug according to claim 1, wherein:

the spark plug has an insulator between said center electrode and said ground electrode;

said bypass electrode is mounted on a surface of said insulator, and is divided into at least two to form a bypass gap between said divided bypass electrodes; and said insulator has a recess at a portion corresponding to said bypass gap.

26. A spark plug according to claim 25, wherein:

a shortest distance along a surface of said recess between said bypass electrodes which are adjacent is within a range between 1.5 times as long as a distance of said bypass gap and 10 times as long as said distance of said bypass gap.

27. A spark plug according to claim 26, wherein:

a distance of said spark gap is within a range between 0.75 mm and 10.0 mm.

28. A spark plug according to claim 1, wherein:

the spark plug has an insulator between said center electrode and said ground electrode; and said bypass electrode is mounted on a surface of said insulator, and lies in a zigzag line along a hypothetical center line between said center electrode and said ground electrode.

29. A spark plug according to claim 28, wherein:

an electric resistance of said zigzag bypass electrode between any two points thereof is smaller than an electric resistance in an air between said two points of said zigzag bypass electrode.

30. A spark plug according to claim 28, wherein:

said zigzag bypass electrode is divided into at least two to form a bypass gap between said divided bypass electrodes.

31. A spark plug according to claim 30, wherein:

said bypass electrode includes a semiconductor material.

32. A spark plug according to claim 31, wherein:

a noble metal chip is integrally mounted on a portion, which is opposed to said spark gap, of said center electrode and said ground electrode.

33. A spark plug according to claim 28, wherein:

a distance of said spark gap is within a range between 0.75 mm and 10.0 mm.

34. A spark plug according to claim 1, wherein:

the spark plug has an insulator between said center electrode and said ground electrode;

said insulator has a recess; and said bypass electrode is mounted on said recess.

35. A spark plug according to claim 34, wherein:

said bypass electrode is divided into at least two to form a bypass gap between said divided bypass electrodes;

said recess has a crest and a trough on its surface; and said bypass electrode is mounted on said crest to form said bypass gap on said trough.

36. A spark plug according to claim 35, wherein:

the spark plug has a plurality of said ground electrodes.

37. A spark plug according to claim 36, wherein:

said bypass electrode includes a semiconductor material.

38. A spark plug according to claim 37, wherein:

a noble metal chip is integrally mounted on a portion, which is opposed to said spark gap, of said center electrode and said ground electrode.

39. A spark plug according to claim 35, wherein:

a distance of said spark gap is within a range between 0.75 mm and 10.0 mm.

40. A spark plug according to claim 1, wherein:

said center electrode has a tip and a main portion;

the spark plug has an insulator that covers said main portion of said center electrode;

said bypass electrode is fixed to said insulator;

said spark plug has a pipe-shaped first main body that is concentrically disposed outside of said insulator, and that fixes said insulator thereto;

said spark plug has a pipe-shaped second main body that is concentrically disposed outside of said first main body;

said first and second main bodies are slidable in an axial direction thereof;

said ground electrode is fixed to said first main body to form said spark gap between said ground electrode and said tip of said center electrode; and the spark plug has an engaging mechanism that engages said first and second main bodies when said first main body is in a first predetermined position in said axial direction, and that disengages said first main body from said second main body such that said first and second main bodies are rotatable each other in its circumferential direction when said first main body is in a second predetermined position in said axial direction.

41. A spark plug according to claim 1, wherein:

said center electrode has a tip and a main portion;

the spark plug has an insulator that covers said main portion of said center electrode;

said bypass electrode is fixed to said insulator;

said spark plug has a pipe-shaped first main body that is concentrically disposed outside of said insulator, and that fixes said insulator thereto;

said spark plug has a pipe-shaped second main body that is concentrically disposed outside of said first main body, and that has a guide on its inner surface for supporting said first main body and said insulator rotatable in a circumferential direction of said first main body;

said ground electrode is fixed to said first main body to form said spark gap between said ground electrode and said tip of said center electrode;

a plurality of notches are formed in an entire circumferential direction and on a part of a surface of said guide in an axial direction thereof with a predetermined circumferential angle between each of said notches;

a projection for engaging it with one of said notches is formed on an outer surface, which is corresponding to said notches, of said first main body;

said first and second main bodies are slidable in an axial direction thereof; and the spark plug has a spring between said first and second main bodies for biasing said first main body to said second main body in said axial direction to maintain a state that said first and second main bodies are engaged such that said first and second main bodies are disengaged to be rotatable each other in said circumferential direction when a predetermined force is applied to said spring.

42. A spark plug according to claim 41, wherein:

the spark plug has a mark thereon to show a circumferential direction of said ground electrode.

43. A spark plug according to claim 1, wherein:

said center electrode has a tip and a main portion;

the spark plug has an insulator that covers said main portion of said center electrode;

said bypass electrode is fixed to said insulator;

said spark plug has a pipe-shaped first main body that is concentrically disposed outside of said insulator, and that fixes said insulator thereto;

said spark plug has a pipe-shaped second main body that is concentrically disposed outside of said first main body, and that has a guide on its inner surface for supporting said first main body and said insulator rotatable in a circumferential direction of said first main body;

said ground electrode is fixed to said first main body to form said spark gap between said ground electrode and said tip of said center electrode;

a plurality of notches are formed in an entire circumferential direction and on a part of a surface of said guide in an axial direction thereof with a predetermined circumferential angle between each of said notches;

a projection for engaging it with one of said notches is formed on an outer surface, which is corresponding to said notches, of said first main body;

said first and second main bodies are slidable in an axial direction thereof; and said second main body has a fastening member to maintain a state that said first and second main bodies are engaged by fastening said fastening member such that said first and second main bodies are disengaged to be rotatable each other in said circumferential direction when said fastening member is unfasten.

44. A spark plug according to claim 43, wherein:

the spark plug has a mark thereon to show a circumferential direction of said ground electrode.

* * * * *